US007188718B2

(12) United States Patent
Tomita et al.

(10) Patent No.: US 7,188,718 B2
(45) Date of Patent: Mar. 13, 2007

(54) CLUTCH DEVICE FOR TRANSMITTING DRIVE POWER TO TRANSMISSION RECEIVING MEMBER

(75) Inventors: Shigemitsu Tomita, Yokohama (JP); Masanobu Kawamoto, Yokohama (JP)

(73) Assignee: Nifco Inc., Yokohama (JP)

( * ) Notice: Subject to any disclaimer, the term of this patent is extended or adjusted under 35 U.S.C. 154(b) by 213 days.

(21) Appl. No.: 11/061,781

(22) Filed: Feb. 22, 2005

(65) Prior Publication Data

US 2005/0189191 A1 Sep. 1, 2005

(30) Foreign Application Priority Data

Feb. 27, 2004 (JP) ..... 2004-053408

(51) Int. Cl.
*F16D 11/04* (2006.01)

(52) U.S. Cl. ..... 192/24; 192/69.8; 192/89.12

(58) Field of Classification Search ..... 192/24, 192/89.21

See application file for complete search history.

(56) References Cited

U.S. PATENT DOCUMENTS 962,567 A * 6/1910 Hancock ..... 192/24
5,718,313 A * 2/1998 Sekine ..... 192/24
6,779,640 B2 * 8/2004 Tomita ..... 192/24

FOREIGN PATENT DOCUMENTS

| | | |
|---|---|---|
| GB | 2 407 851 | 5/2005 |
| JP | 6-66328 | 3/1994 |
| JP | 11-5335 | 1/1999 |
| JP | 2004-92887 | 3/2004 |

* cited by examiner

*Primary Examiner*—Richard M. Lorence
(74) *Attorney, Agent, or Firm*—Manabu Kanesaka

(57) ABSTRACT

A clutch device for transmitting drive power to a transmission-receiving member includes a main shaft; an input side rotating body; an output side rotating body; an inner sleeve body; an outer sleeve body; a braking device; a first coil spring; a first main connection part; a second main connection part; a first sub connection part; a second sub connection part; a first cam surface; a second cam surface; a first catching surface; a second catching surface; an outermost cylinder body; and a second coil spring. Non-transmitting condition can be surely set even if an input side rotational force is small.

5 Claims, 23 Drawing Sheets

CLUTCH DEVICE FOR TRANSMITTING DRIVE POWER TO TRANSMISSION RECEIVING MEMBER

BACKGROUND OF THE INVENTION AND RELATED ART STATEMENT

The invention relates to a clutch device disposed between a transmission-receiving member and a drive motor for transmitting drive power from the drive motor to the transmission-receiving member. Accordingly, it is possible to drive the transmission-receiving member such as a paper feed roller in a photocopier, facsimile, printer, and the like upon receiving the drive power of the drive motor.

As a clutch device for transmitting drive power to a paper feed roller in a photocopier and the like, there is one disclosed in Patent Document 1 filed by the applicant.

Such a clutch device has an input side rotating body, an output side rotating body, an inner sleeve body, an outer sleeve body, and braking means for the outer sleeve body rotating around a main shaft. The inner sleeve body is assembled on the output side rotating body in a state being capable of rotation only in the axial direction of the main shaft. The input side rotating body and the inner sleeve body are connected by a main connection part, and the inner sleeve body and the outer sleeve body are connected by a sub connection part. A catching surface is formed on the sub connection part. When the accompanying rotation of the outer sleeve body is stopped by the braking means, the inner sleeve body is moved slightly by inertia in the direction of forward rotation, while compressing and contracting a coil spring for urging in the direction of connecting the main connection part of the inner sleeve body to the main connection part of the input side rotating body with a cam surface on the sub connection part. As a result, the connection between the main connection parts is broken, and also the sub connection parts contact with each other at the catching surfaces. Also, a state in which the rotational force of the input side rotating body is not transmitted to the output side rotating body (OFF state) is maintained.

Accordingly, in such a clutch device, since the production of the OFF state is made to depend on the inertial forward rotation of the inner sleeve body, there is a room to perform further work on the mechanism for assuredly producing the OFF state even when the rotational force acting on the input side rotating body is not very great.

Patent Document 1: Japanese Patent Application No. 2002-258744.

An object of the present invention is to provide a clutch device, in which the drive power from the input side is transmitted without loss to the output side during transmission of drive power, and resistance is not caused to the extent possible in idle rotation of the input side rotating body constituting the clutch device during non-transmission of drive power. Also, the state of non-transmission of drive power is assuredly produced even when the drive power on the input side is not very great.

Further objects and advantages of the invention will be apparent from the following description of the invention.

SUMMARY OF THE INVENTION

In order to solve the aforementioned problems, according to the present invention, a clutch device transmits drive power to a transmission-receiving member such as a paper feed roller in a photocopier, facsimile, printer, or the like. The clutch device includes the following components (1)–(14).

(1) a main shaft;

(2) an input side rotating body rotating around the main shaft;

(3) an output side rotating body rotating around the main shaft for transmitting drive power to a transmission-receiving member such-as a paper feed roller;

(4) an inner sleeve body disposed between an input end part of the input side rotating body and an output end part of the output side rotating body, and assembled on the output side rotating body in a state capable of moving only in an axial direction of the main shaft;

(5) an outer sleeve body disposed between the input end part of the input side rotating body and the output end part of the output side rotating body in a state of holding the inner sleeve body inside;

(6) braking means of the outer sleeve body; and (7) a first coil spring with one end fastened to the inner sleeve body for always urging the inner sleeve body in the direction of pushing against a side of the input end part of the input side rotating body and the other end fixed to the outer sleeve body.

(8) On each of the inner sleeve body and the input side rotating body, there is provided a main connection part for engaging through the force and disengaging by movement of the inner sleeve body toward the direction against the force.

(9) On each of the inner sleeve body and the outer sleeve body, there is provided a sub connection part for rotating the outer sleeve body through a forward rotation of the inner sleeve body engaging the main connection part of the input side rotating body.

(10) Either one or both of the sub connection part of the inner sleeve body and the sub connection part of the outer sleeve body has/have a cam surface which, by stopping of the accompanying rotation of the outer sleeve body by the braking means, moves the inner sleeve body in a direction against the force so as to compress or stretch the first coil spring in its axial direction and to accumulate in the first coil spring force in reverse of the direction of forward rotation of the inner sleeve body.

(11) A catching surface formed on the sub connection part of the inner sleeve body and oriented toward the input end part of the input side rotating body is positioned at a level substantially same as a catching surface formed on the sub connection part of the outer sleeve body and oriented toward the output end part of the output side rotating body at a position where the inner sleeve body is completely moved against the force.

(12) There is provided an outermost cylinder body assembled on the outside of the outer sleeve body for retaining at least a part of the outer sleeve body therein in a state that the inner sleeve body rotates within a fixed range relative to the outer sleeve body, and having a part on an outer surface part thereof for receiving an action of braking force of said braking means, so that the accompanying rotation of the outer sleeve body is stopped by the action of the braking force on the part.

(13) There is provided a second coil, spring with one end fastened to the outer sleeve body and the other end fastened to the outermost cylinder body.

(14) The second coil spring accumulates a force for rotating the outer sleeve body in reverse of the direction of forward rotation of the inner sleeve body by a force-accumulating action of the outer sleeve body in which the accompanying rotation is stopped after rotating in the same direction as the direction of forward rotation of the inner sleeve body within the fixed range when the braking force is applied to the outermost cylinder body.

In the structure:

(1) First, in the state in which the accompanying rotation of the outer sleeve body is not stopped by the outermost cylinder body by applying the braking force to the outermost cylinder body by the braking means, the clutch device becomes the IN state (state in which drive power is transmitted).

That is, because the main connection part of the inner sleeve body engages the main connection part of the input side rotating body by the force of the first coil spring, and because the inner sleeve body engages the output side rotating body in a state being capable of movement only in the axial direction of the main shaft, the rotational force of the input side rotating body is transmitted to the output side rotating body by the inner sleeve body, and the output side rotating body is rotated. (Below, rotation in this direction is called forward rotation.)

Also in the IN state, by the contact between the sub connection part of the inner sleeve body and the sub connection part of the outer sleeve body, the outer sleeve body also is rotated in accompaniment around the main shaft in the same direction as the inner sleeve body and the output side rotating body. (That is, all of them are rotated forward.) Furthermore, because the outermost cylinder body is assembled on the outside of the outer sleeve body so as to retain at least a part of the outer sleeve body therein in a state allowing rotation of the inner sleeve body within a fixed range relative to the outer sleeve body, the outermost cylinder body also is rotated forward.

(2) Next, when the forward rotation of the outermost cylinder body is stopped by the braking means, the accompanying rotation of the outer sleeve body also is stopped, and the clutch device becomes the OFF state (state in which drive power is not transmitted).

That is, when the rotation of the outer sleeve body rotating in accompaniment in the IN state is stopped by the braking means via the outermost cylinder body, the inner sleeve body rotating is moved backward, while rotating forward, in the direction against the forcing, that is, in the direction of disengaging between the main connection part of the inner sleeve body and the main connection part of the input side rotating body, by the cam surface provided on both or either one of the sub connection part of the inner sleeve body and the sub connection part of the outer sleeve body.

When it is disengaged in this manner, the rotational force of the input side rotating body is no longer transmitted to the output side rotating body. The catching surface of the sub connection part of the inner sleeve body completely pushed in toward the direction of disengaging in this manner is positioned at substantially the same level as the catching surface of the sub connection part of the outer sleeve body. (Below, this state is called intermediate state.)

On the other hand, although the accompanying rotation of the outer sleeve body is stopped after being rotated in the same direction as the direction of forward rotation of the inner sleeve body within the fixed range when the braking force is applied to the outermost cylinder body, because the force causing the outer sleeve body to rotate in reverse of the forward direction of the inner sleeve body (that is, reverse rotate) is accumulated in the second coil spring by this action, the outer sleeve body is rotated in reverse by the elastic force of the second coil spring, whereby the catching surface of the sub connection part of the inner sleeve body and the catching surface of the sub connection part of the outer sleeve body contact each other. Even if the rotational force in the direction of forward rotation acting on the inner sleeve body, that is, the rotational force acting on the input side rotating body, is not great, by the action of the second coil spring, the state of contact between the catching surface of the sub connection part of the inner sleeve body and the catching surface of the sub connection part of the outer sleeve body is produced assuredly. Because the inner sleeve body is subject to the force by the first coil spring, unless the state in which the accompanying rotation of the outer sleeve body is stopped is broken, the inner sleeve body does not return to the position where its main connection part engages the main connection part of the input side rotating body.

In the OFF state, the input side rotating body rotates idly without load around the main shaft. In this OFF state, although the first coil spring attempts to return to the ON state by causing the inner sleeve body to rotate in reverse and causing the outer sleeve body to rotate forward, because the outermost cylinder body is stopped, the outer sleeve body is not rotated forward past the intermediate state and up to the ON state. Also, because force in the direction of causing the outer sleeve body to rotate in reverse again is accumulated in the second coil spring when the outer sleeve body is rotated forward within the fixed range, the OFF state is maintained as long as the outermost cylinder body is stopped.

In the case when the first coil spring is a compression coil spring, in the OFF state, the first coil spring is compressed.

On the other hand, in the case when the first coil spring is a tension coil spring, in the OFF state, the first coil spring is stretched.

(3) Also, when the stoppage of the accompanying rotation of the outer sleeve body by the braking means is released from the OFF state, the clutch device again becomes the IN state.

That is, when the action of the braking force on the outermost cylinder body by the braking means is released from the OFF state and the stoppage of the accompanying rotation of the outer sleeve body is released, the outer sleeve body rotates slightly in the direction of forward rotation by the elastic return force of the first coil spring contracted in the OFF state, and the inner sleeve body rotates slightly in the direction of reverse rotation, whereby it returns to the intermediate state. When the return to the intermediate state is accomplished, next, the inner sleeve body is moved in the direction of being pushed against the input end part of the input side rotating body by the elastic return force working in the axial direction of the first coil spring, and the main connection part of the inner sleeve body and the main connection part of the input side rotating body again engage. Accordingly, the output side rotating body again is rotated by the rotational driving of the input side rotating body by the inner sleeve body.

That is, in such a clutch device, in the case when it is not necessary to transmit drive power to the transmission-receiving member, the input side rotating body can be rotated without load, and in the OFF state, the clutch device does not apply a load to the drive motor driving the input side rotating body. Also, in the OFF state, it can be made such that transmission of power to the output side rotating body does not occur at all.

Also, in the event of transmitting the drive power to the transmission-receiving member, by engaging the main connection part of the inner sleeve body and the main connection part of the input side rotating body, the rotational force can be transmitted to the output side rotating body without power loss.

It is preferred that the maximum value of the force accumulated in the first coil spring be made greater than the maximum value of the force accumulated in the second coil spring.

Accordingly, the return from the intermediate state to the IN state can be accomplished smoothly.

That is, when moving from the OFF state to the intermediate state is performed, force in the direction of causing the outer sleeve body to rotate in reverse is accumulated again in the second coil spring. If the maximum value of the force accumulated in the first coil spring is made greater than the maximum value of the force accumulated in the second coil spring, the outer sleeve body can rotate appropriately in the direction of forward rotation by the elastic return force of this first coil spring, whereby it can be returned from the intermediate state to the IN state without obstruction.

It also may be that: the cam surface of the sub connection part of the inner sleeve body is made as a surface oriented toward the direction of forward rotation of the inner sleeve body, i.e., an inclined surface inclined toward the side of the direction of reverse rotation of the inner sleeve body as it approaches the catching surface of the sub connection part. The cam surface of the sub connection part of the outer sleeve body is made as a surface oriented toward the direction of reverse rotation of the inner sleeve body, i.e., an inclined surface inclined toward the side of the direction of forward rotation of this inner sleeve body as it approaches the catching surface of this sub connection part.

In the case when it is made as such, moving from the ON state to the intermediate state can be accomplished more smoothly.

According to the clutch device of the invention, it can be made such that the drive power from the input side is transmitted without loss to the output side during transmission of drive power, and resistance is not caused to the extent possible in idle rotation of the input side rotating body constituting the clutch device during non-transmission of drive power. Also, the state of non-transmission of drive power can be assuredly produced even when the drive power on the input side is not very great.

DETAILED DESCRIPTION OF PREFERRED EMBODIMENTS

Hereunder, embodiments of the present invention will be explained with reference to FIG. 1 through FIG. 31.

Figure 1:
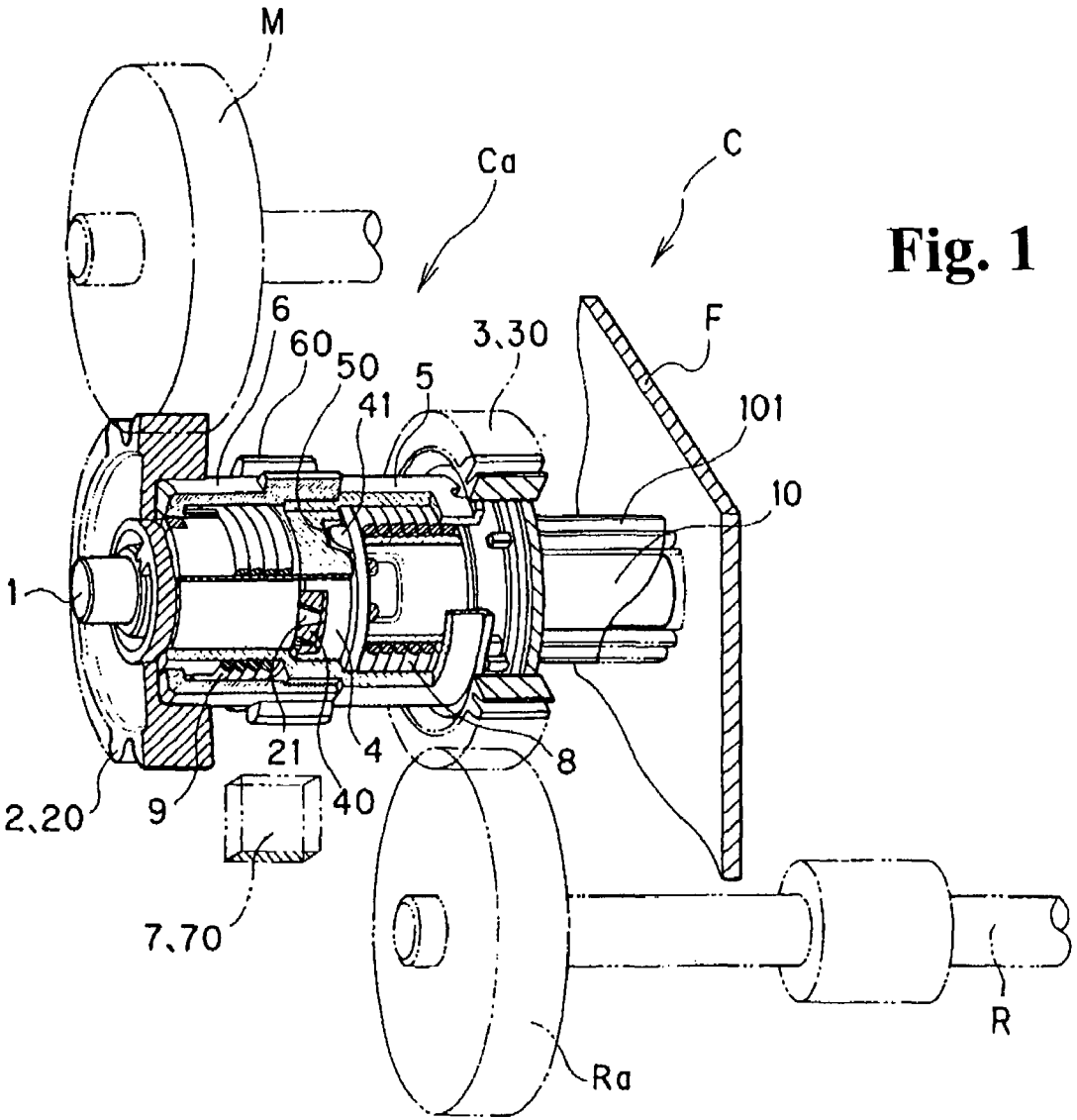
FIG. 1 is an partial sectional perspective view showing essential parts of a clutch device C in a use state.

Here, FIG. 1 shows an overall constitution of a clutch device C according to an embodiment.

Figure 2:
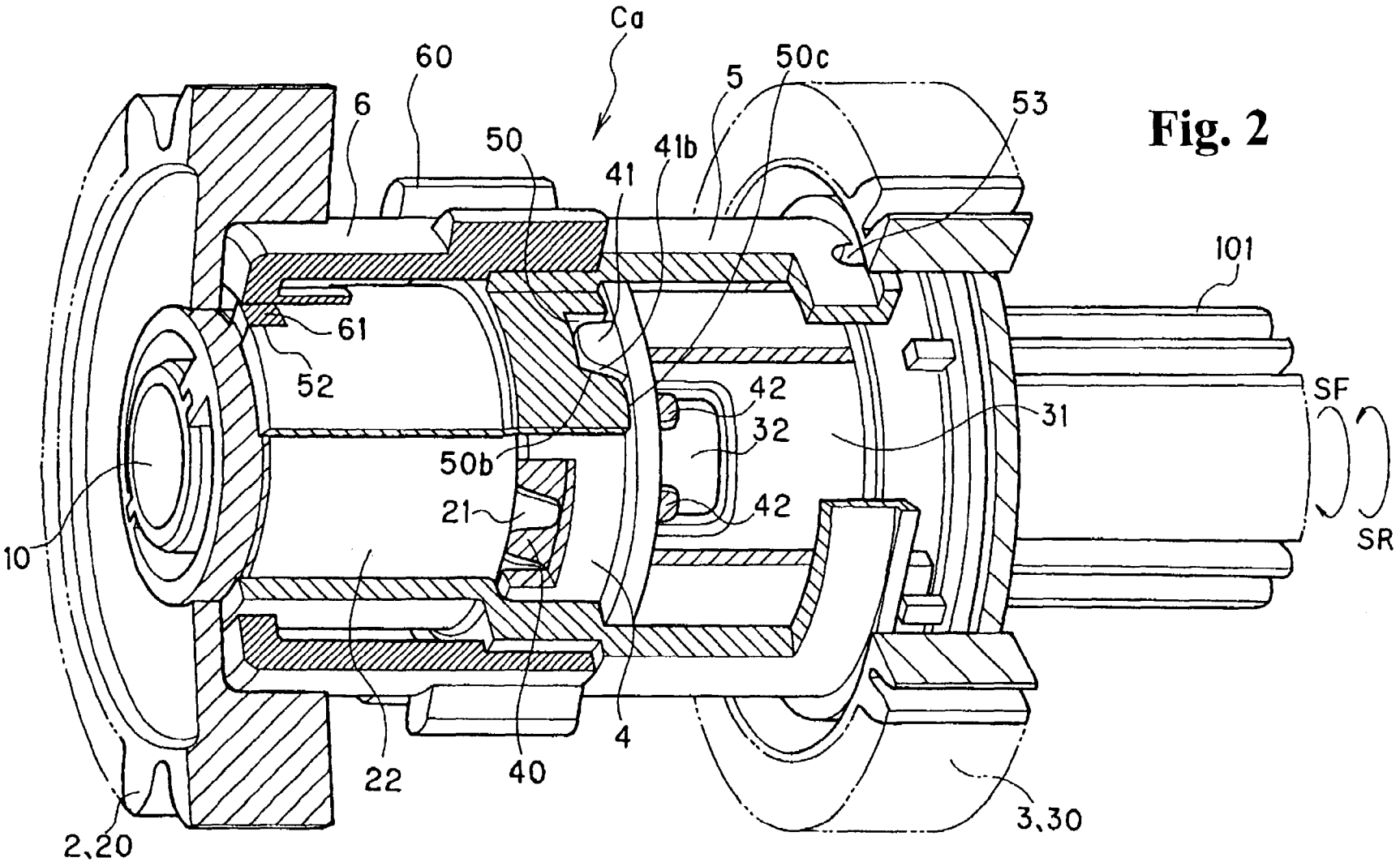
FIG. 2 is a partial sectional perspective view showing essential parts of a clutch main body Ca (IN state)
Figure 3:
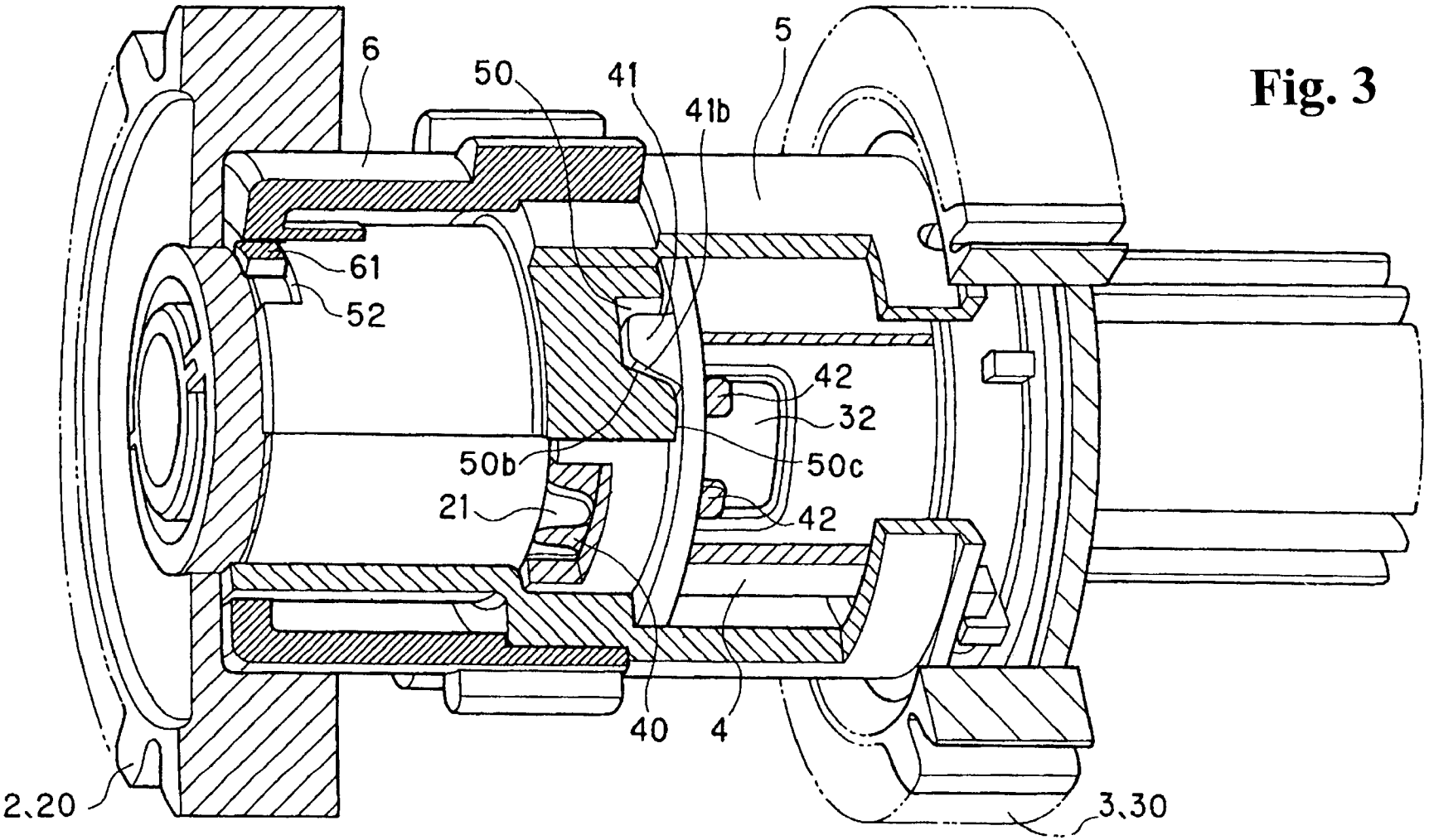
FIG. 3 is a partial sectional perspective view showing the essential parts of the clutch main body Ca.
Figure 4:
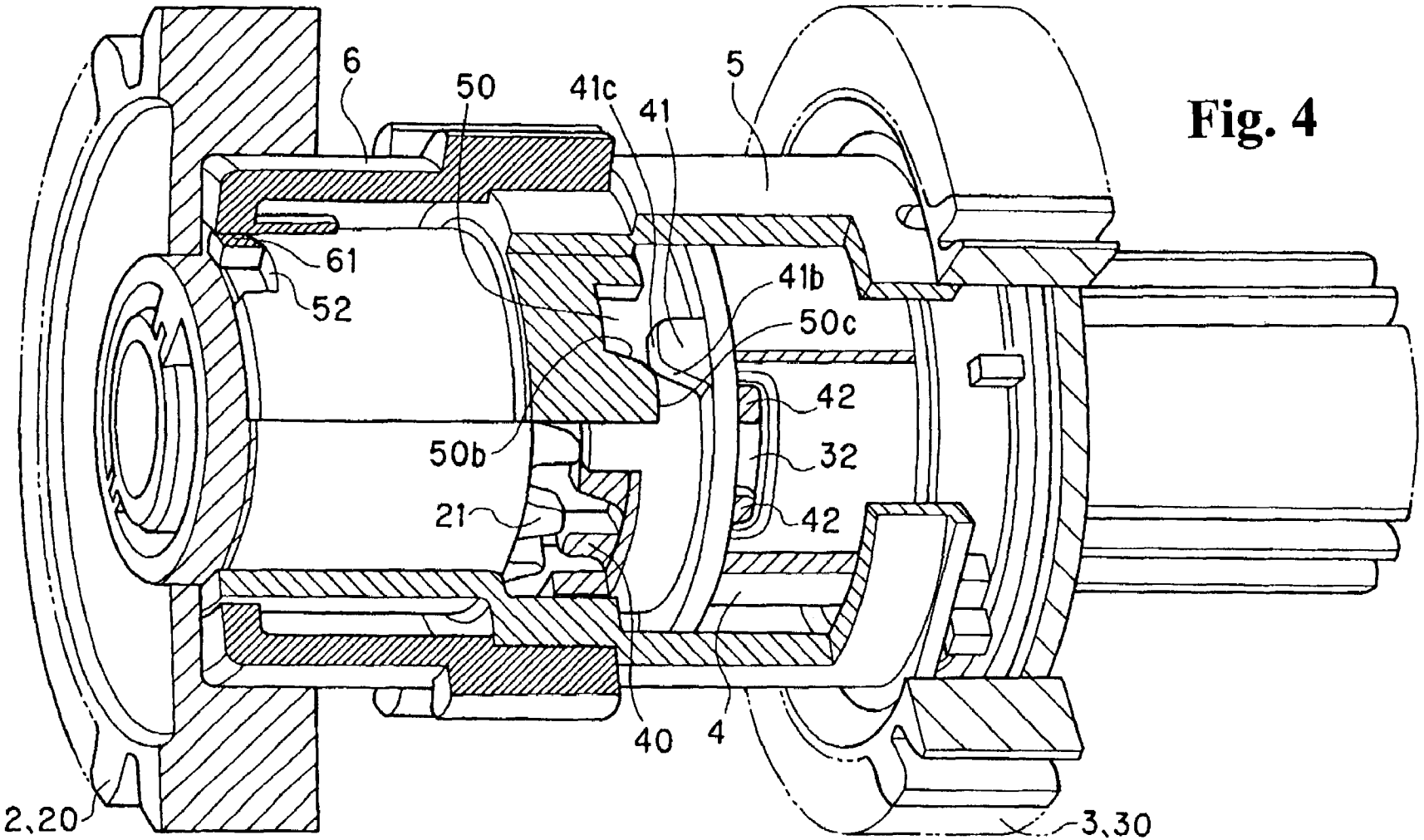
FIG. 4 is a partial sectional perspective view showing the essential parts of the clutch main body Ca.
Figure 5:
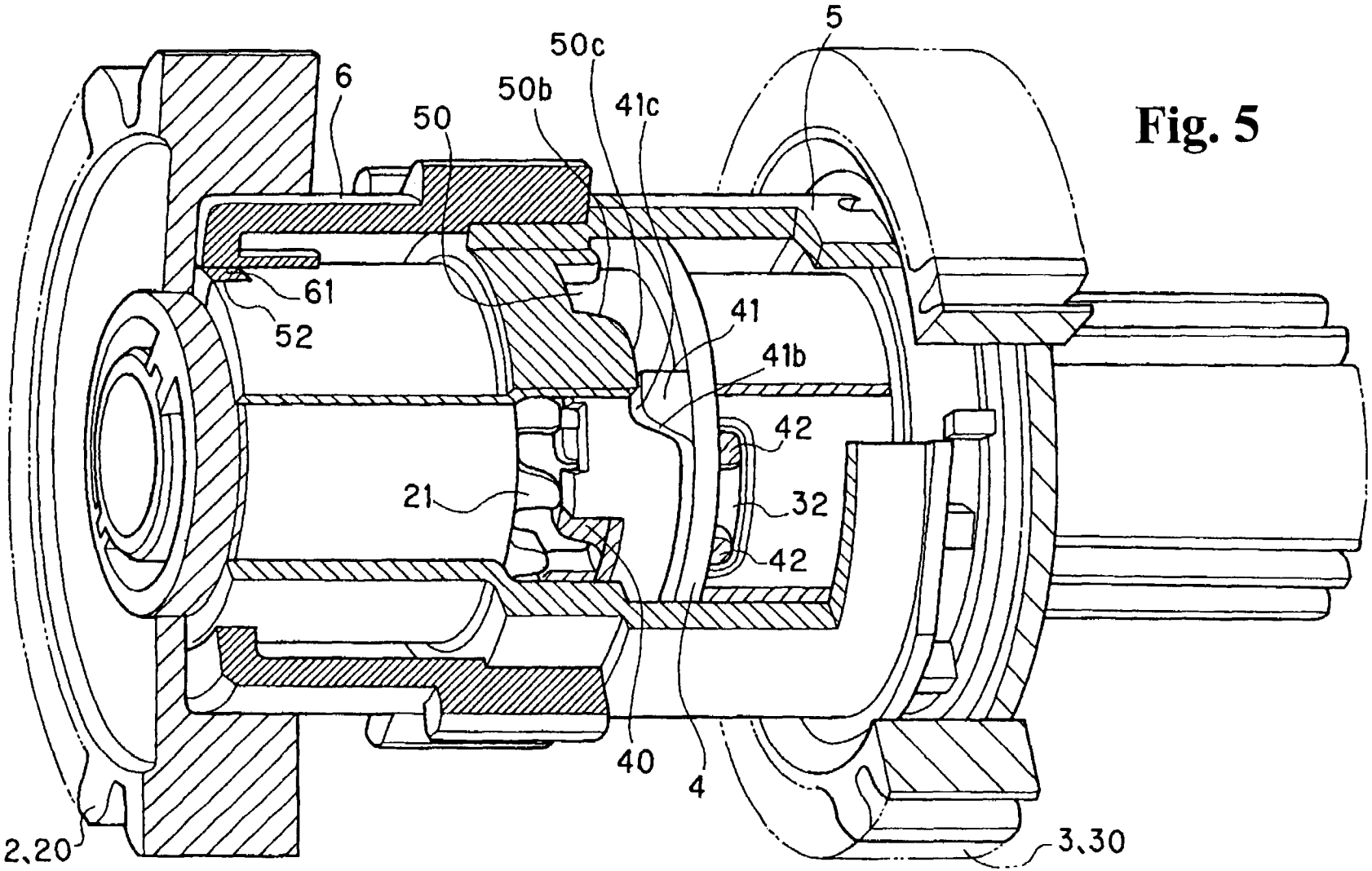
FIG. 5 is a partial sectional perspective view showing the essential parts of the clutch main body Ca (OFF state)
Figure 6:
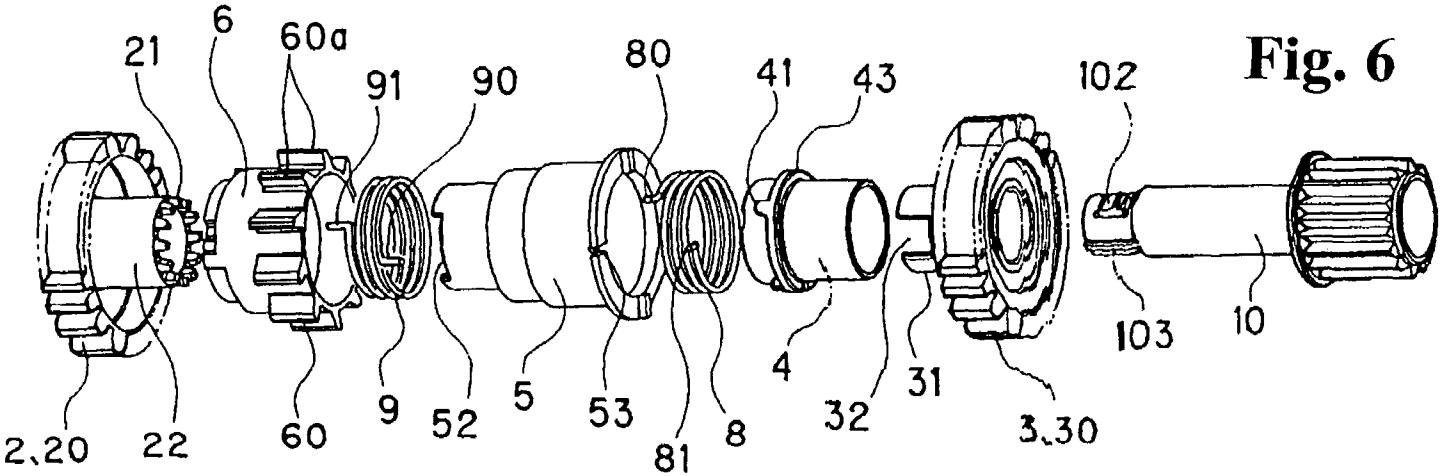
FIG. 6 is an exploded perspective view of the clutch main body Ca.
Figure 7:
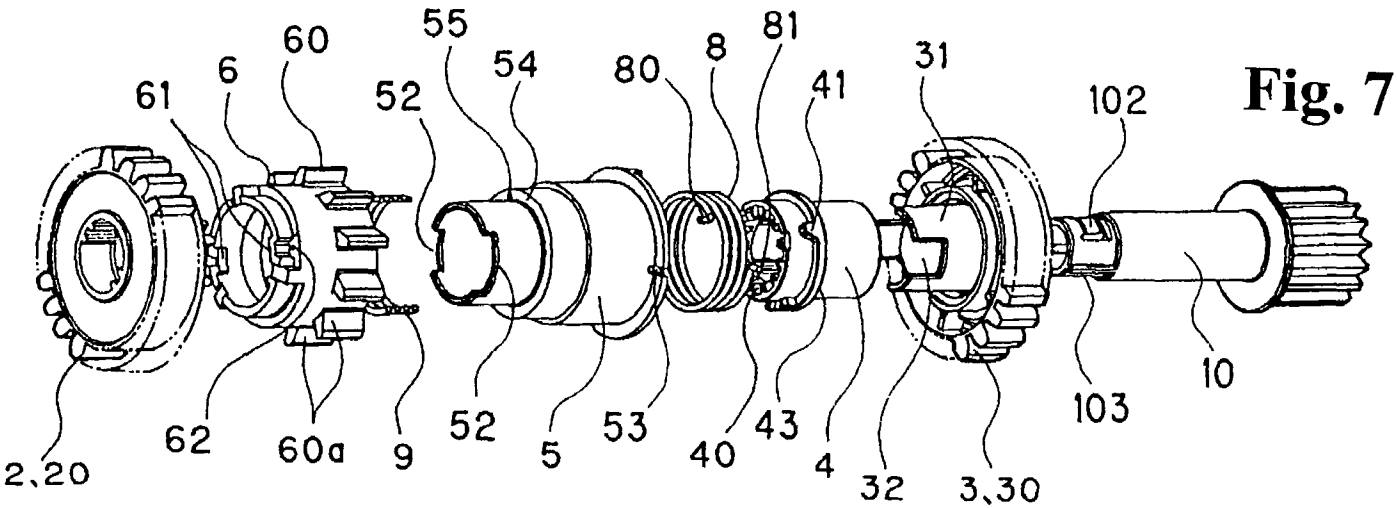
FIG. 7 is an exploded perspective view of the clutch main body Ca.
Figure 8:
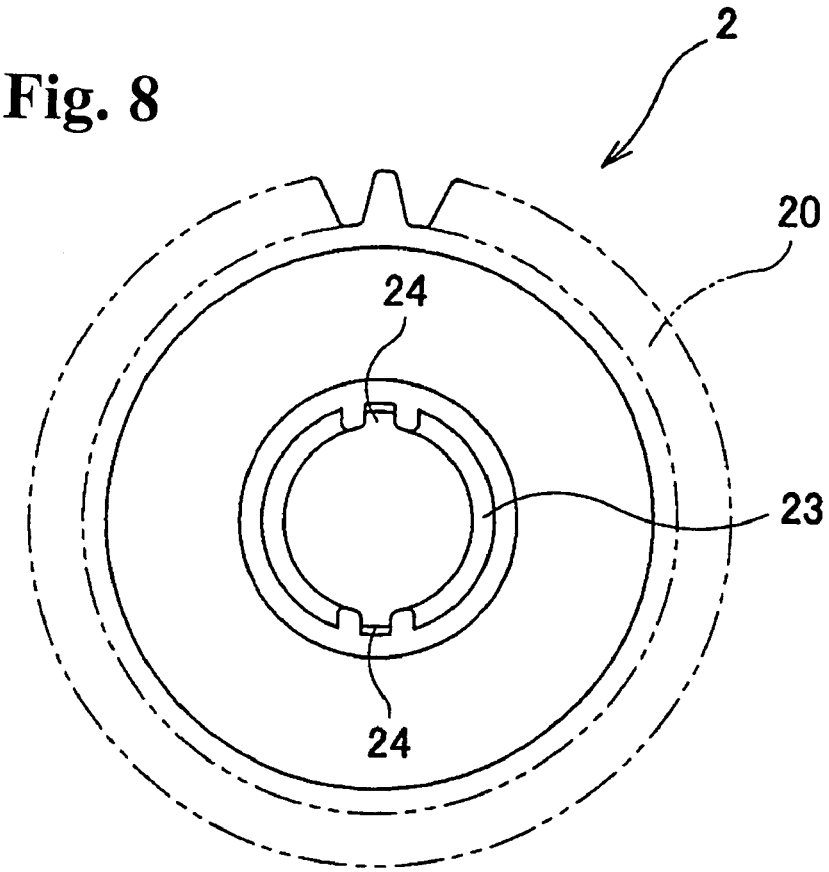
FIG. 8 is a plan view of an input side rotating body 2.
Figure 9:
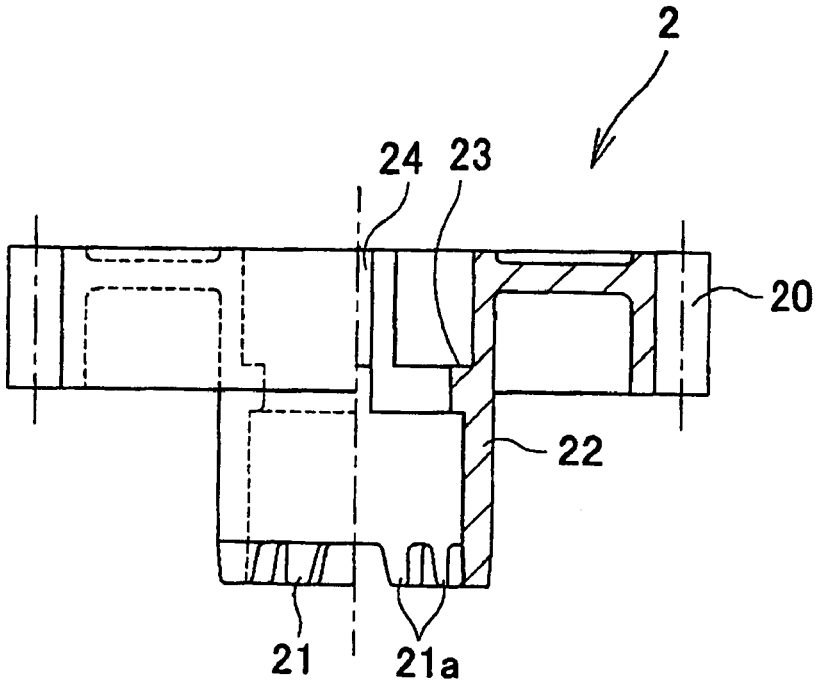
FIG. 9 is a partial sectional side view of the same.
Figure 10:
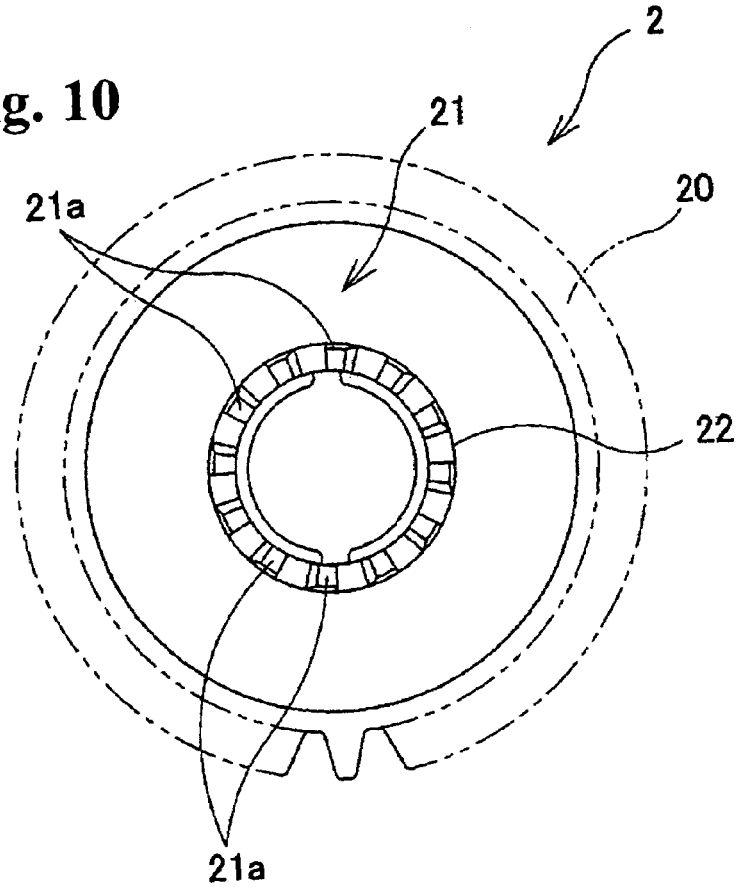
FIG. 10 is a bottom view of the same.
Figure 11:
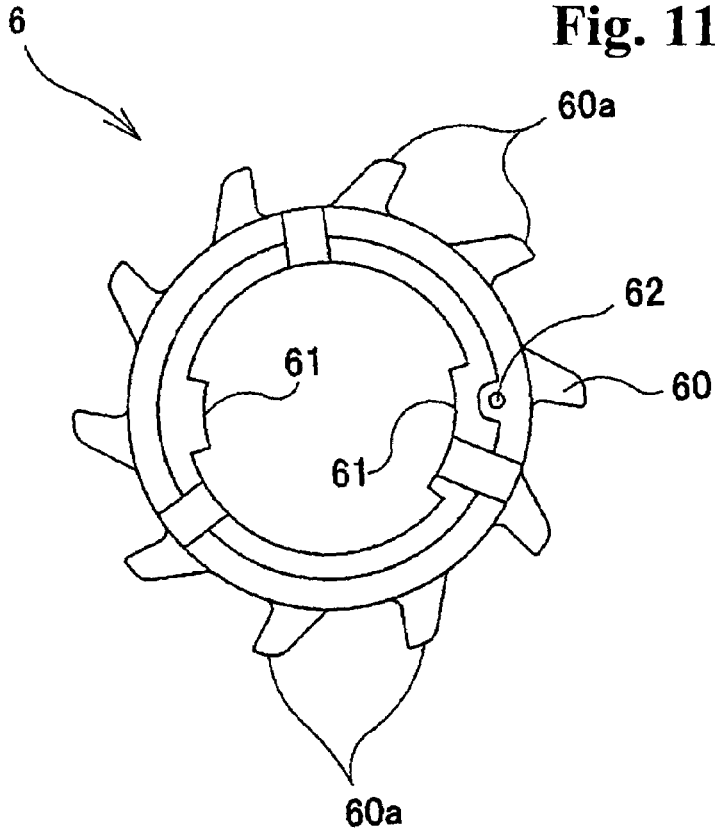
FIG. 11 is a plan view of an outermost cylinder body 6.
Figure 12:
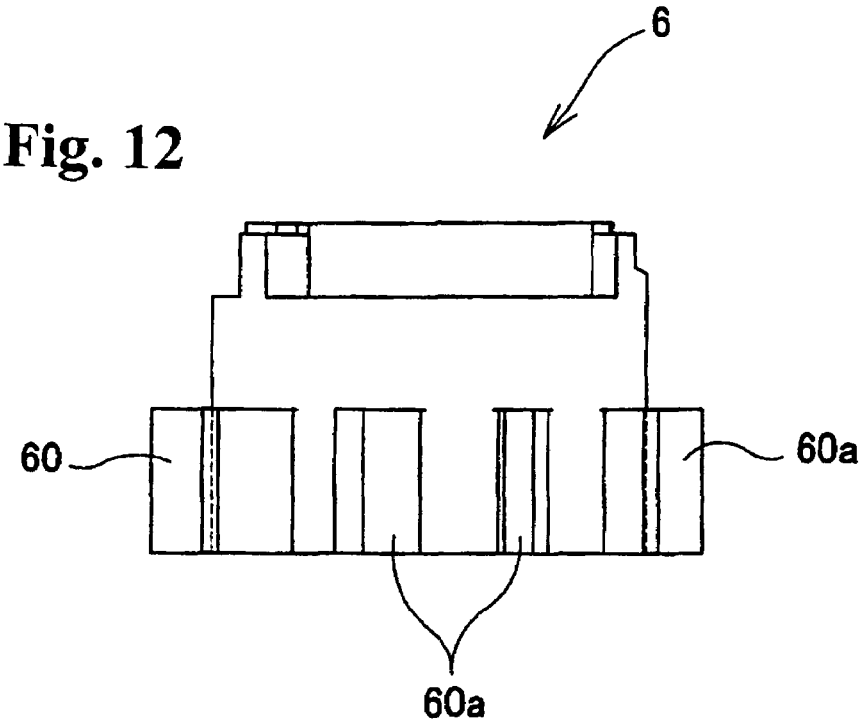
FIG. 12 is a side view of the same.
Figure 13:
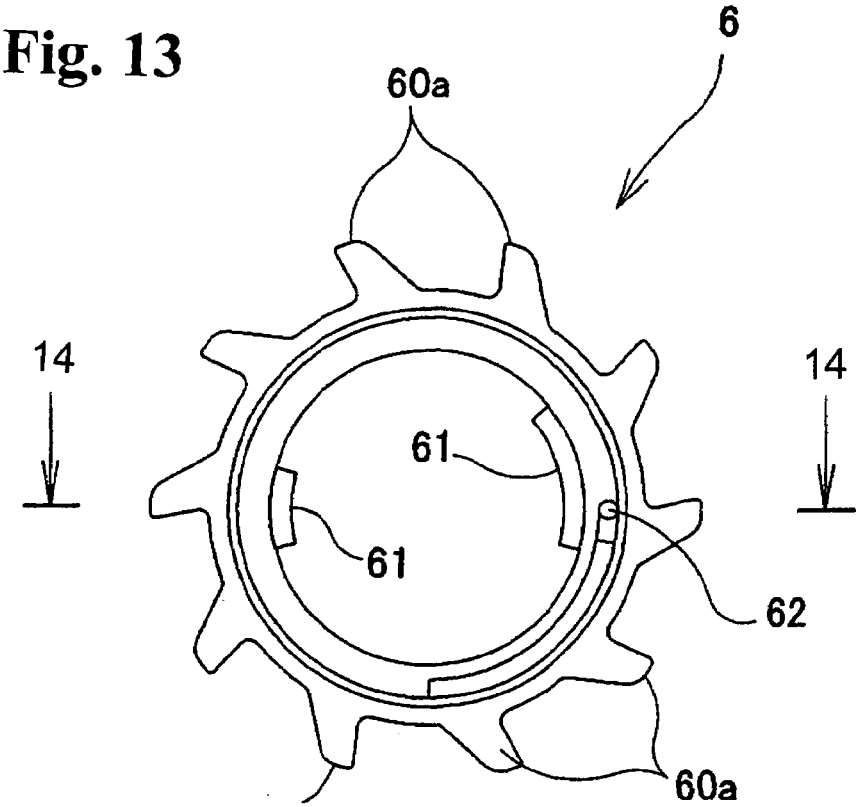
FIG. 13 is a bottom view of the same.
Figure 14:
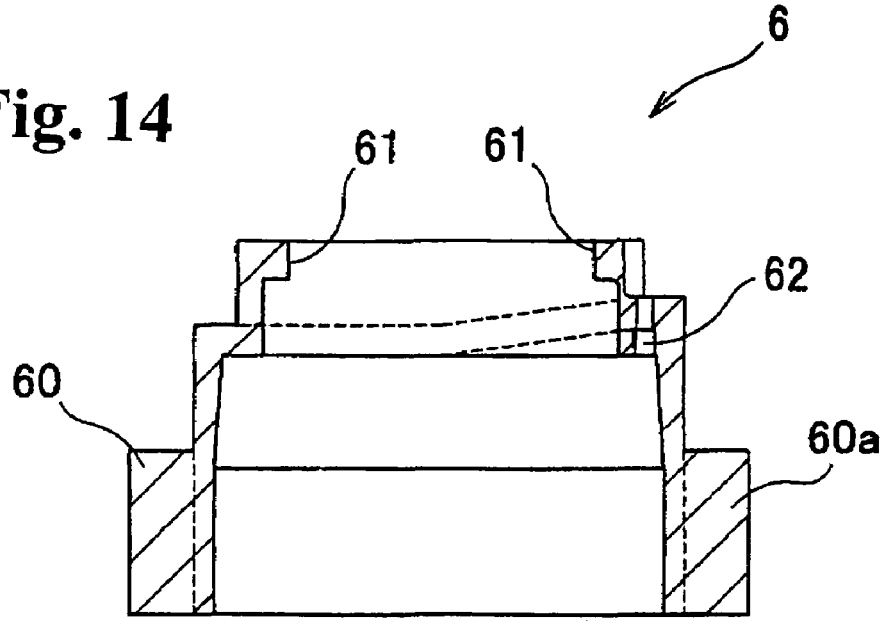
FIG. 14 is a sectional view taken along line 14—14 in FIG. 13.
Figure 15:
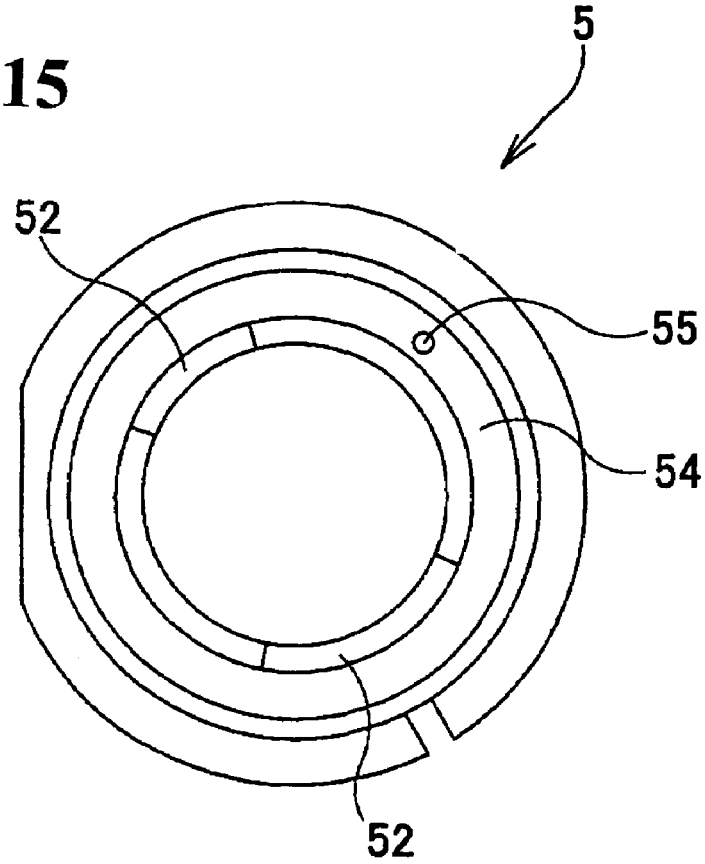
FIG. 15 is a plan view of an outer sleeve body 5.
Figure 16:
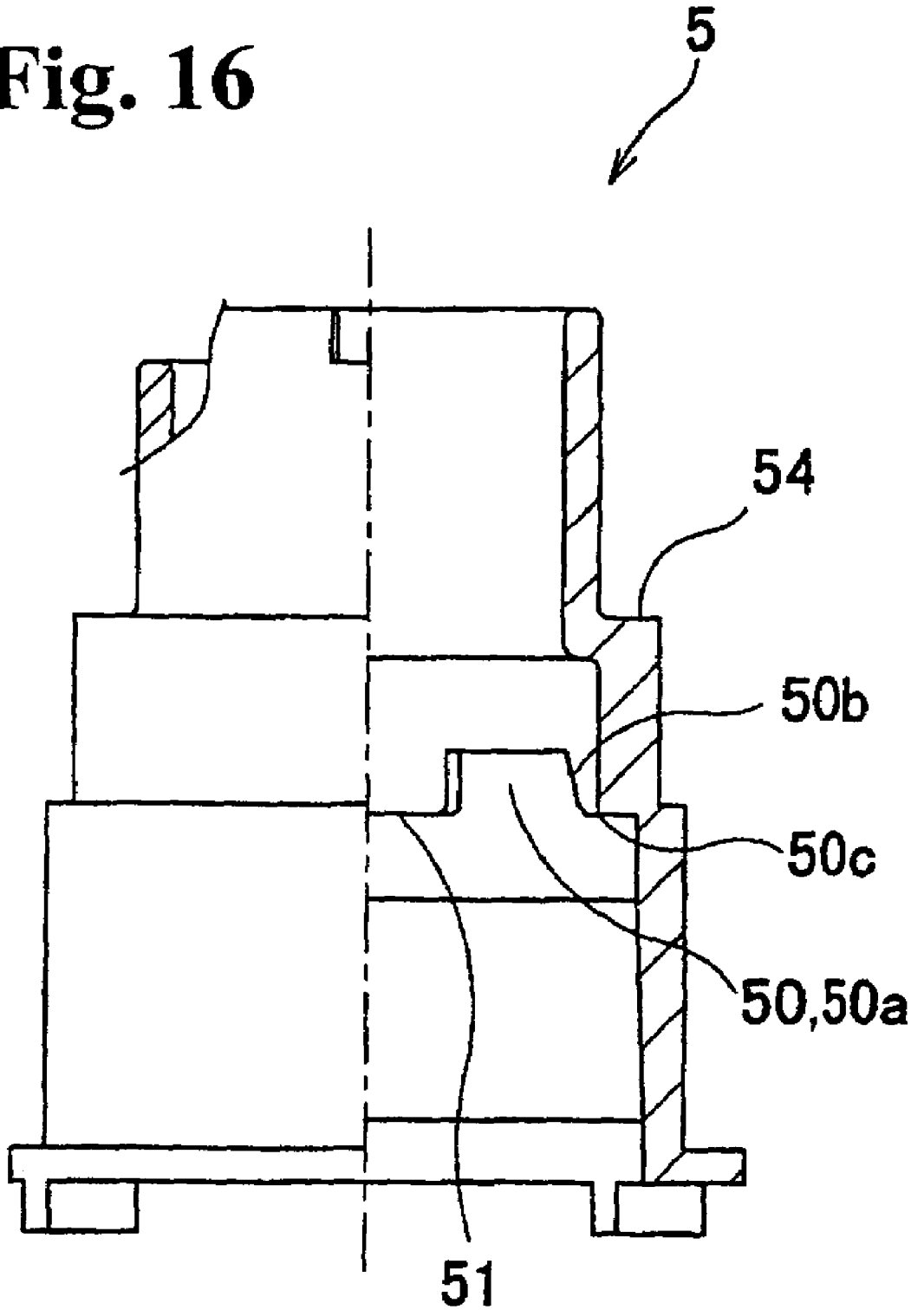
FIG. 16 is a partial sectional side view of the same.
Figure 17:
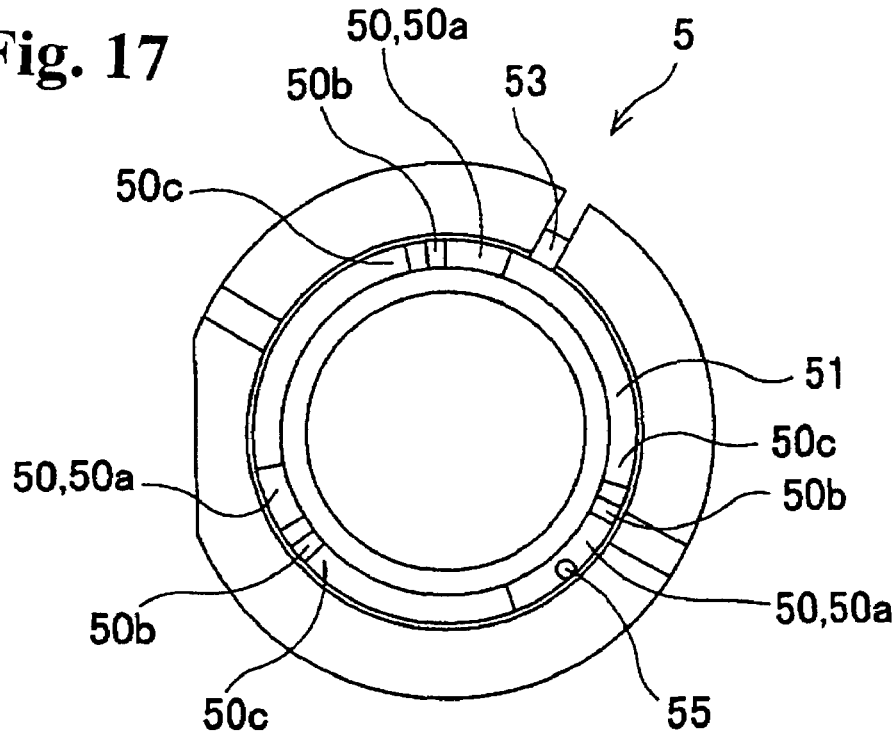
FIG. 17 is a bottom view of the same.
Figure 18:
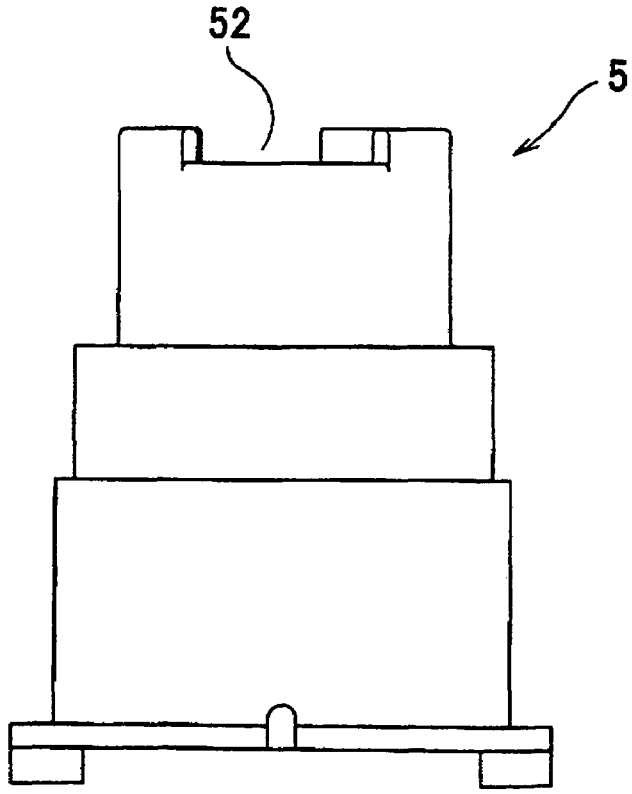
FIG. 18 is a side view of the same.
Figure 19:
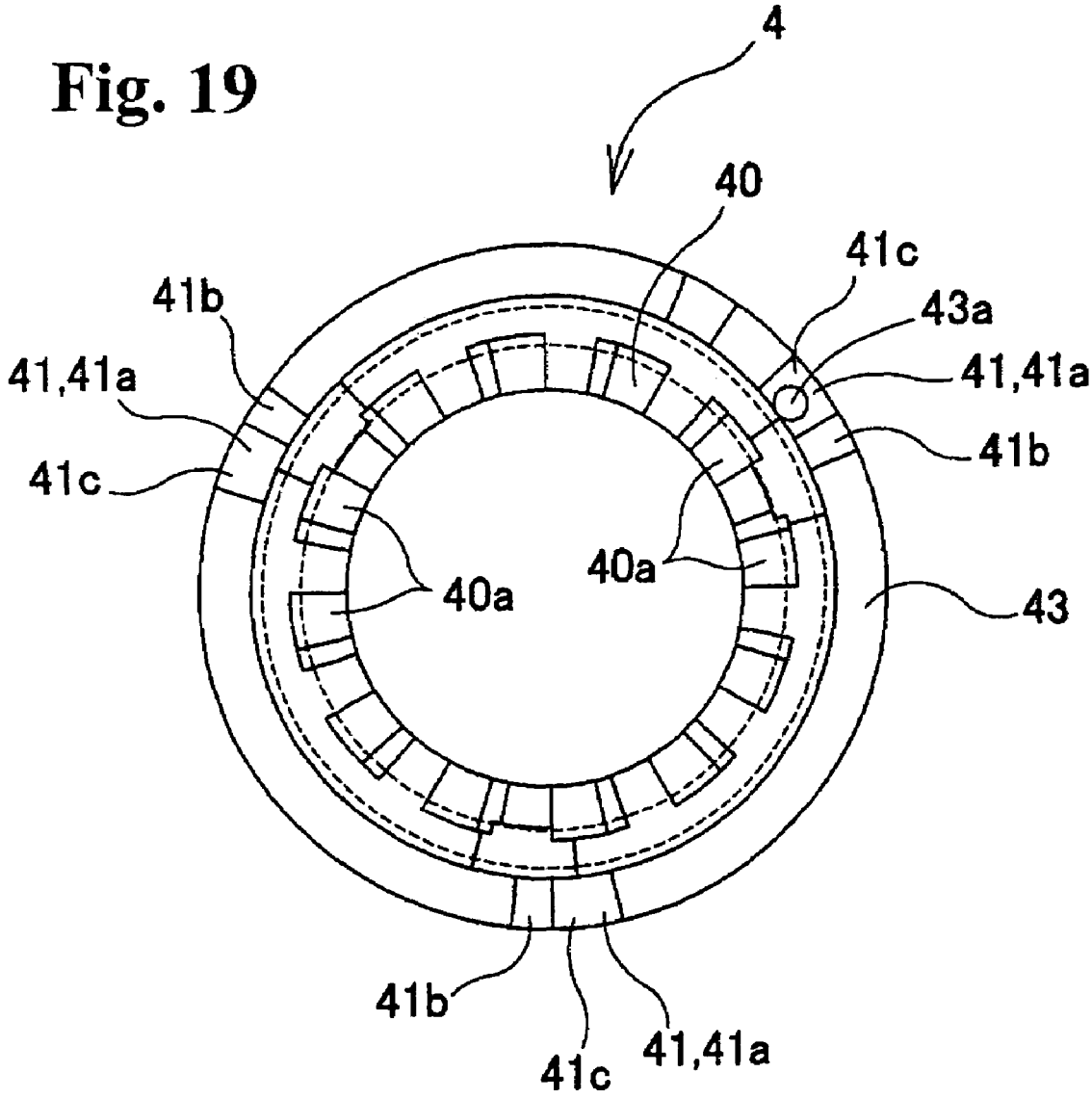
FIG. 19 is a plan view of an inner sleeve body 4.
Figure 20:
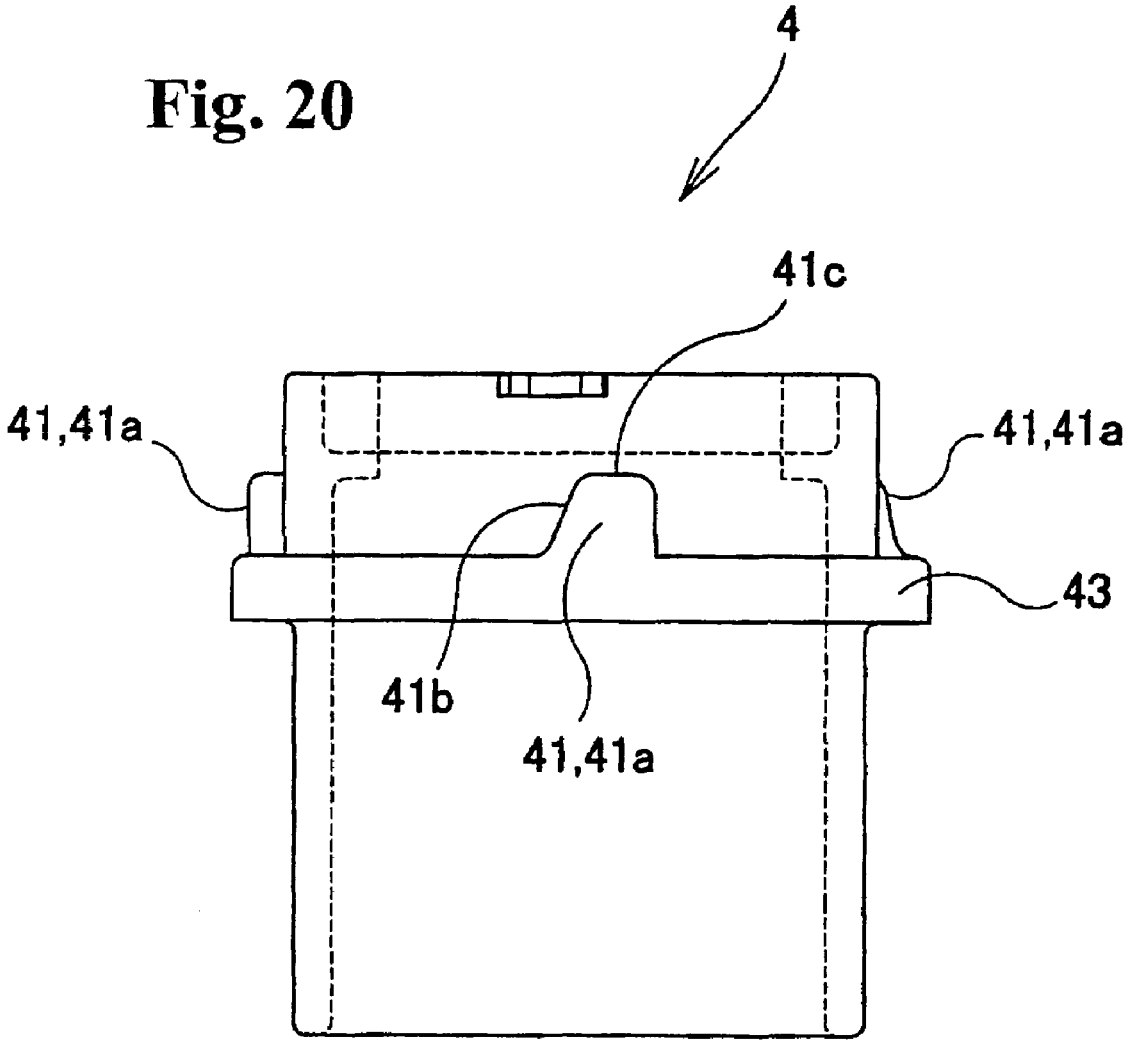
FIG. 20 is a side view of the same.
Figure 21:
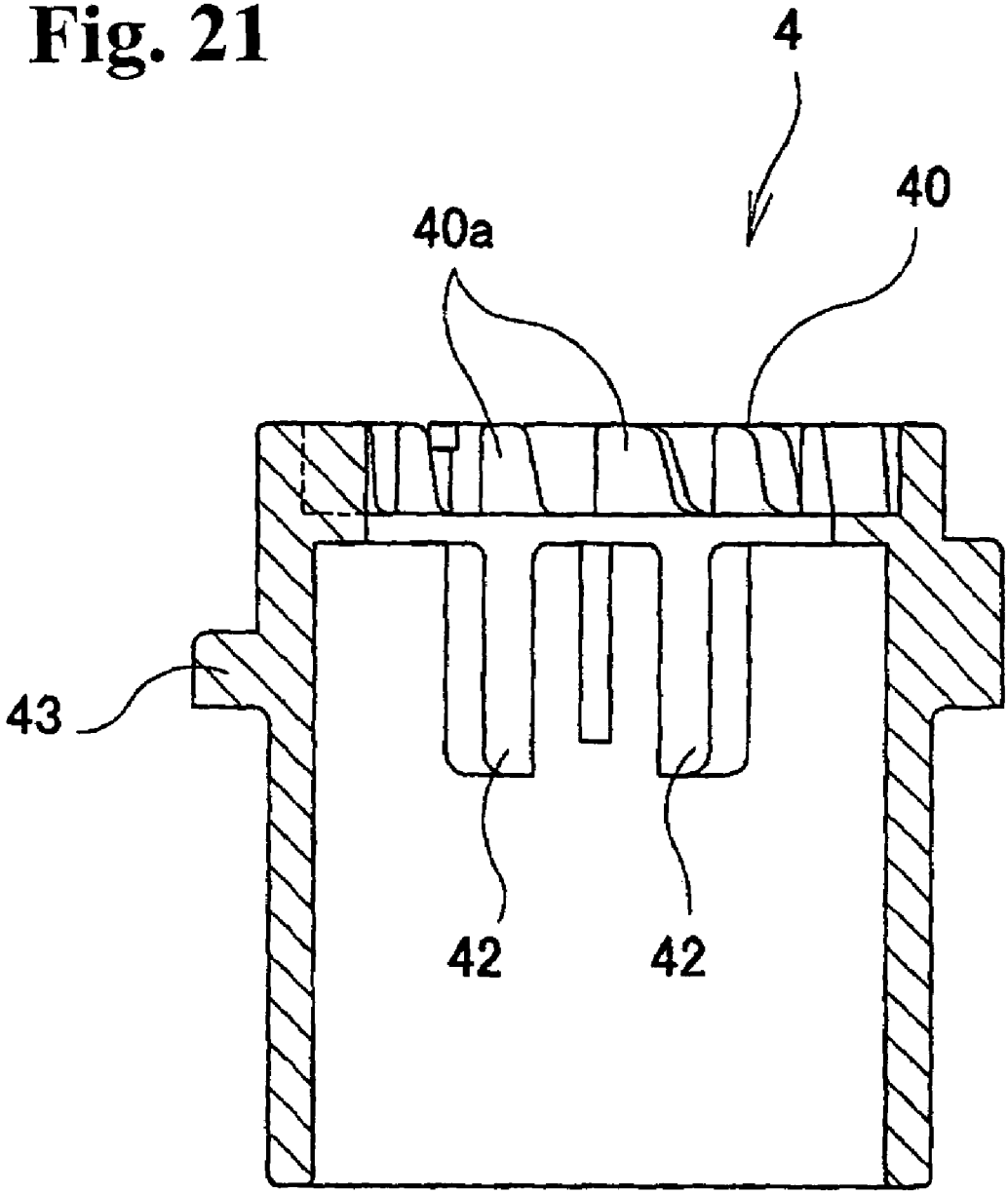
FIG. 21 is a sectional view of the same.
Figure 22:
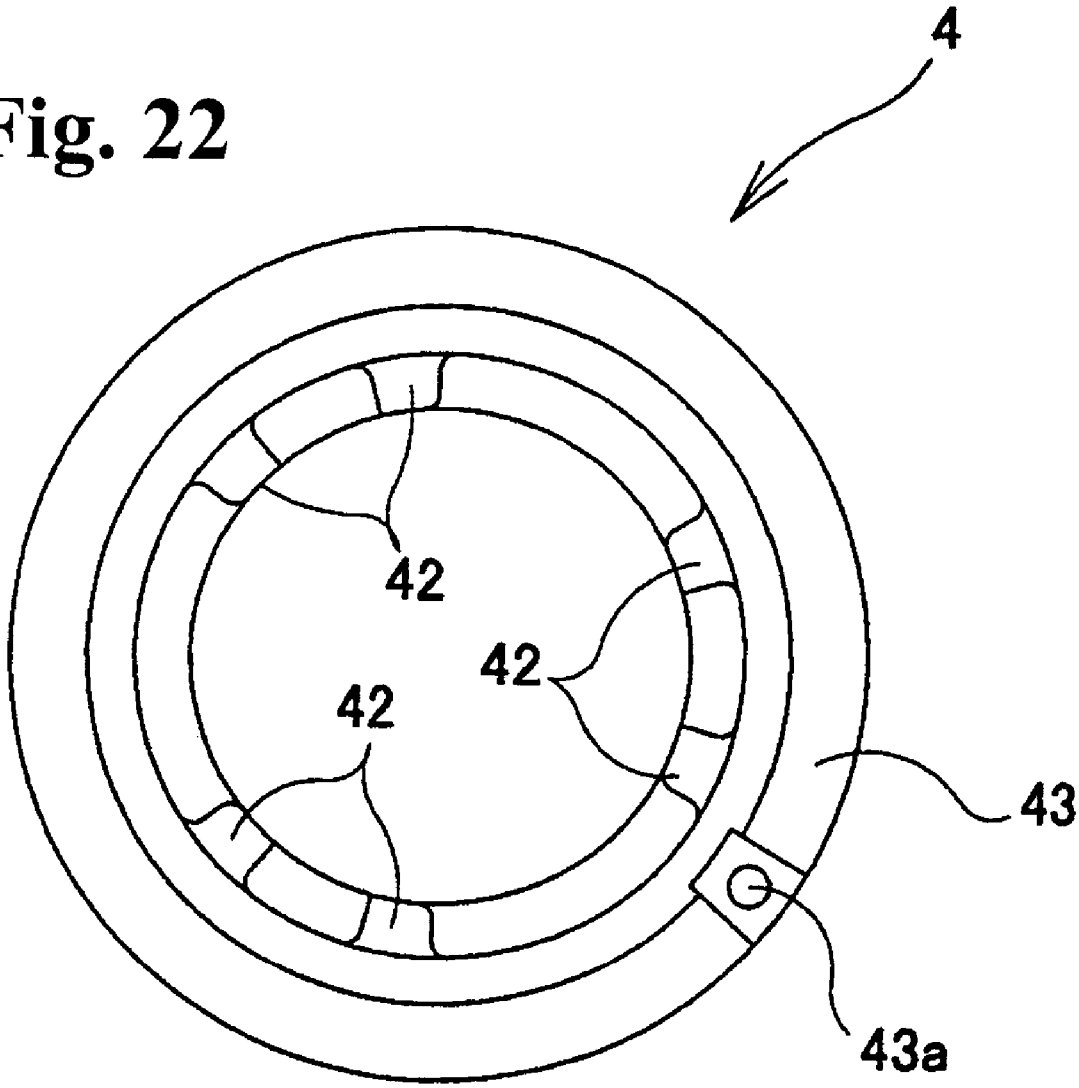
FIG. 22 is a plan view of the same.
Figure 23:
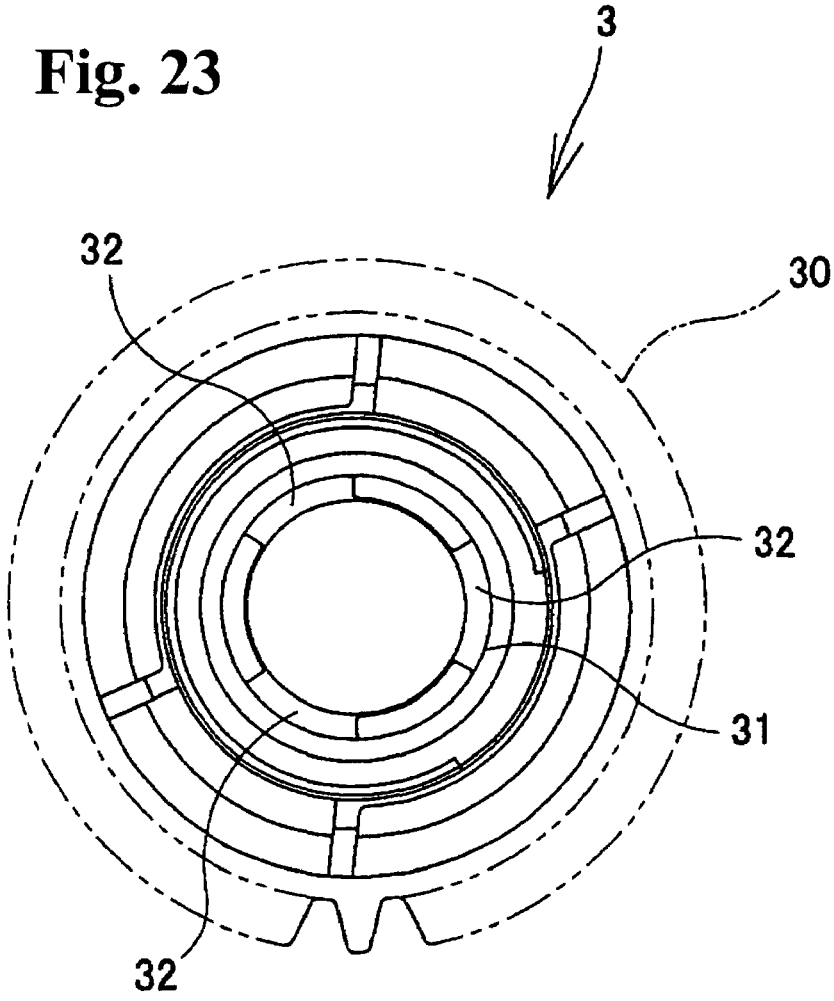
FIG. 23 is a plan view of an output side rotating body 3.
Figure 24:
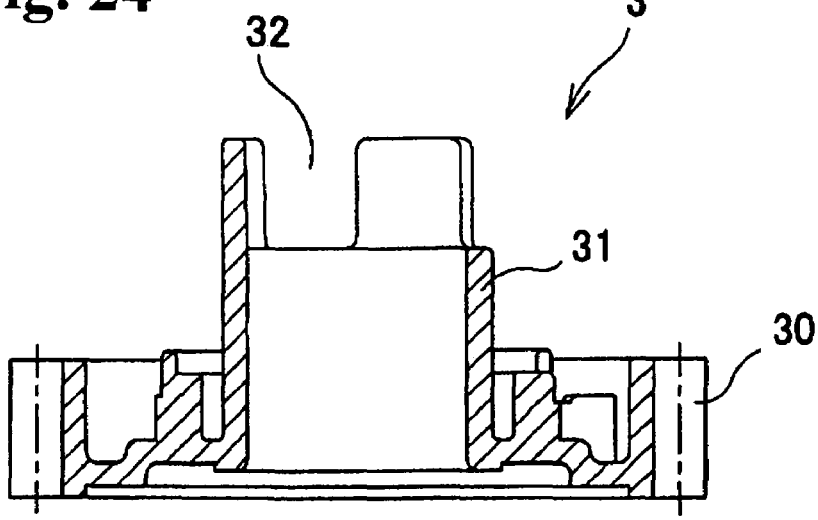
FIG. 24 is a sectional view of the same.
Figure 25:
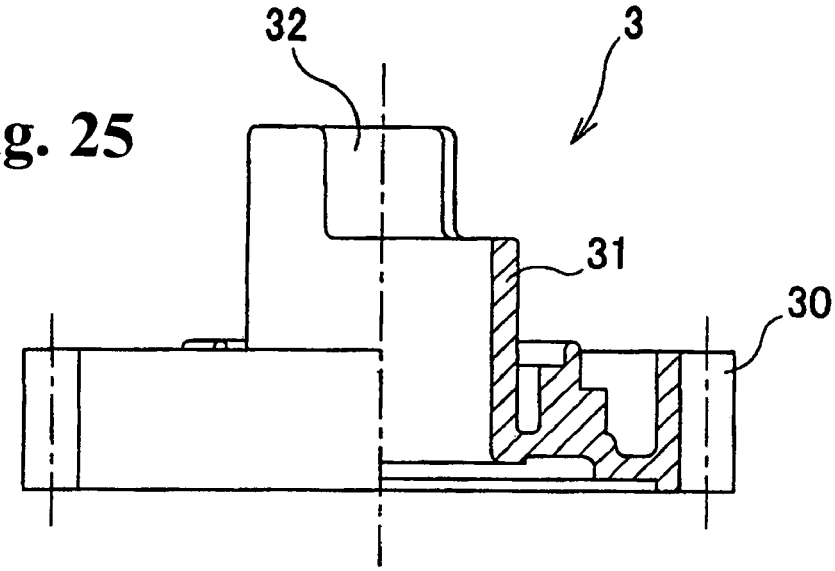
FIG. 25 is a partial sectional side view of the same.
Figure 26:
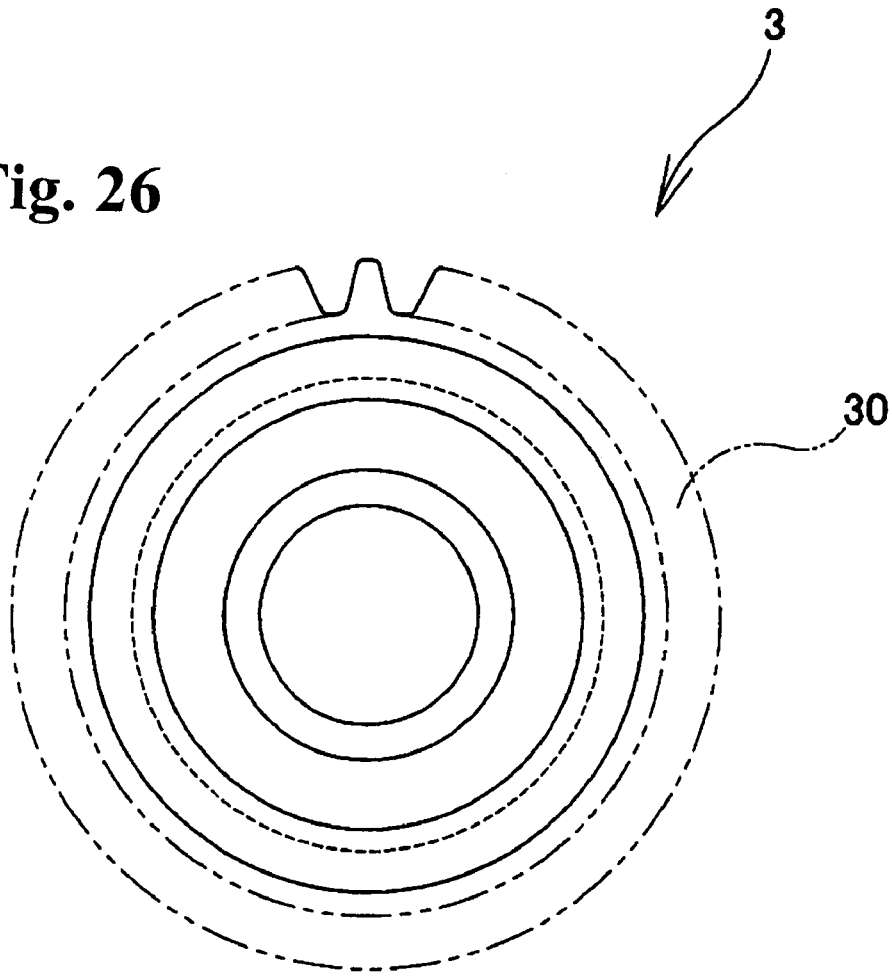
FIG. 26 is a bottom view of the same.
Figure 27:
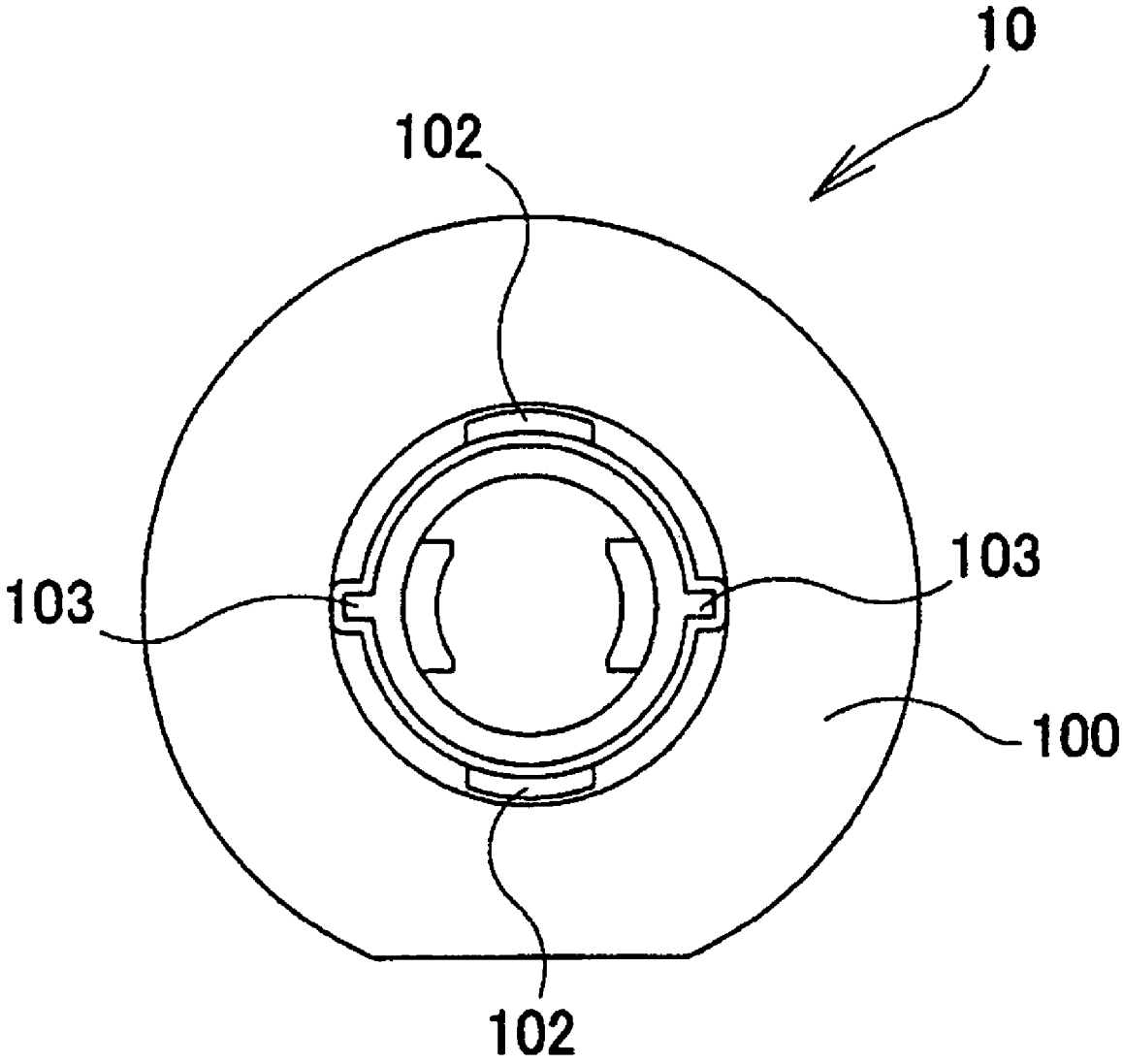
FIG. 27 is a plan view of an innermost cylinder body 10.
Figure 28:
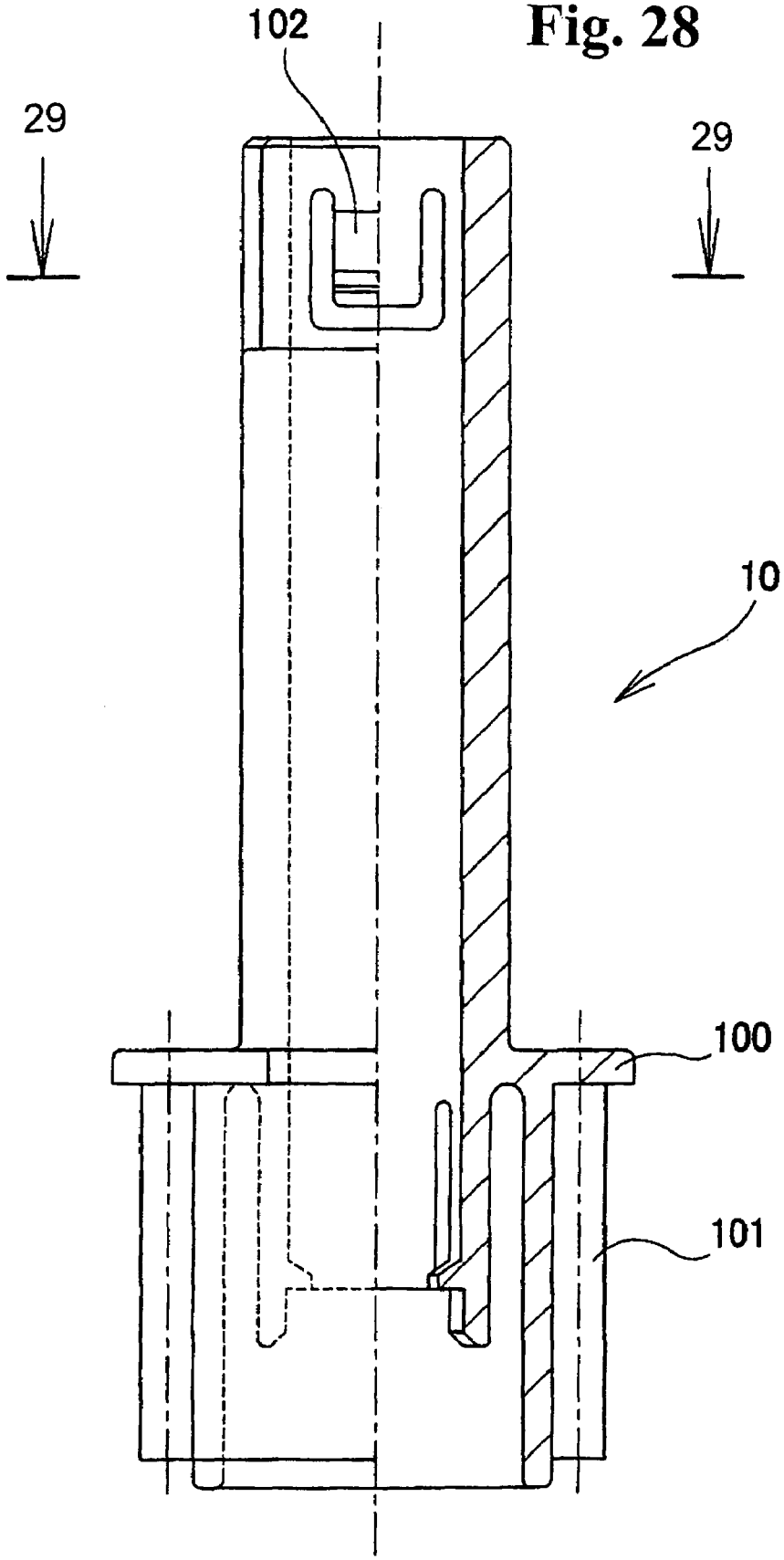
FIG. 28 is a partial sectional side view of the same.
Figure 29:
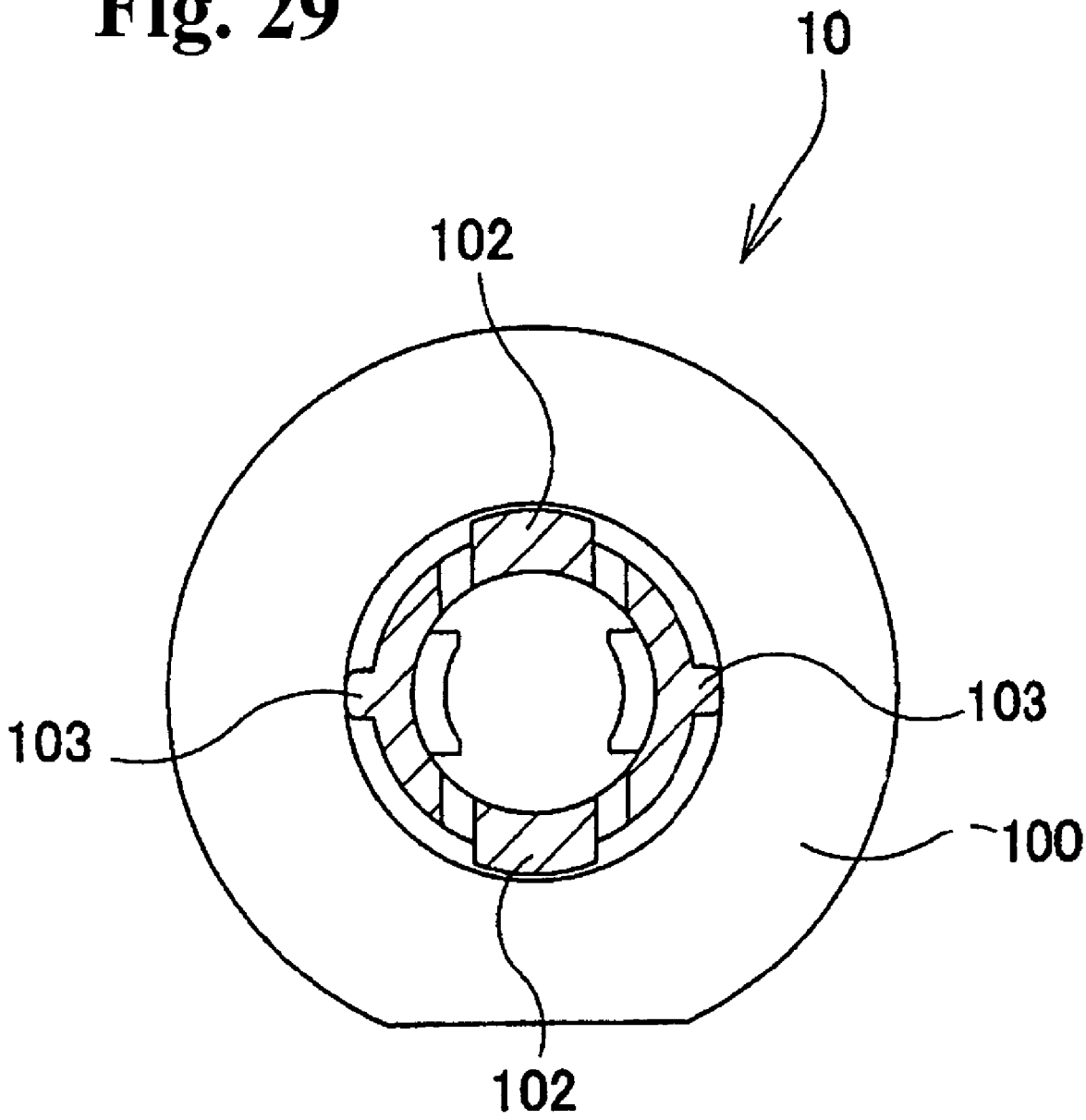
FIG. 29 is a sectional view taken along line 29—29 in FIG. 28.
Figure 30:
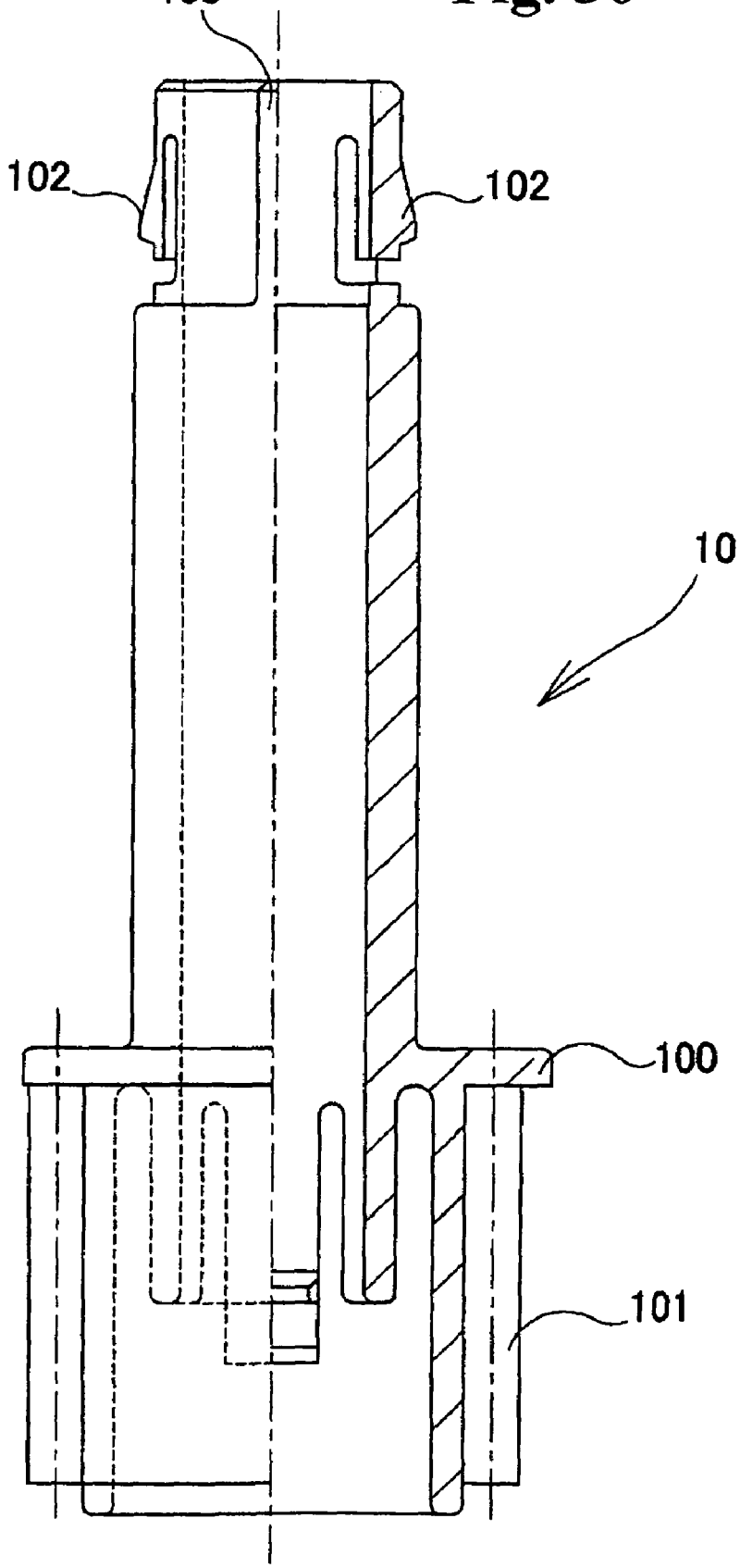
FIG. 30 is a partial sectional side-view of the innermost cylinder body 10.
Figure 31:
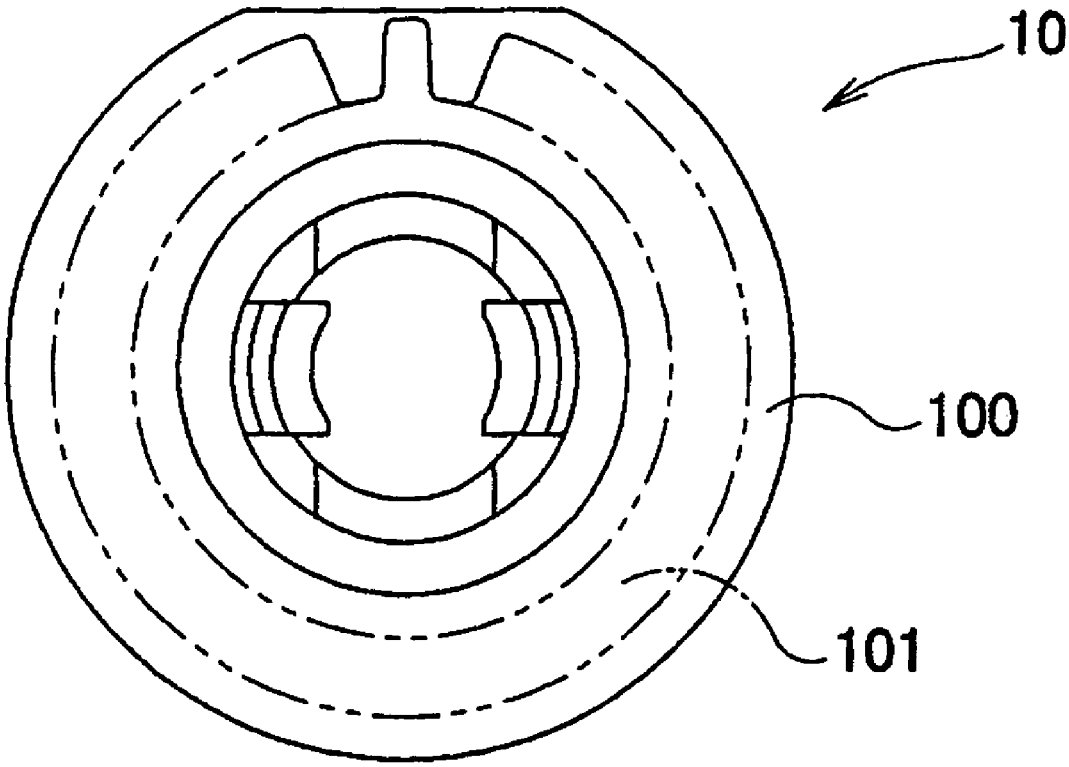
FIG. 31 is a bottom view of the same.

FIG. 2 shows a clutch main body Ca in an IN state to be described later, and FIG. 5 shows the clutch main body Ca in an OFF state to be described later. Also, FIG. 3 and FIG. 4 show a state in the course of moving from the IN state to the OFF state. That is, it moves from the IN state to the OFF state in the order of FIG. 2, FIG. 3, FIG. 4, and FIG. 5, and it moves from the OFF state to the IN state in the order of FIG. 5, FIG. 4, FIG. 3, and FIG. 2. (In FIG. 2 through FIG. 5, a first coil spring 8 and a second coil spring 9 are omitted.) Also, FIG. 6 and FIG. 7 show each member constituting the clutch main body Ca in a disassembled state. Also, FIG. 8 through FIG. 10 show an input side rotating body 2, FIG. 11 through FIG. 14 show an outermost cylinder body 6, FIG. 15 through FIG. 18 show an outer sleeve body 5, FIG. 19 through FIG. 22 show an inner sleeve body 4, FIG. 23 through FIG. 26 show an output side rotating body 3, and furthermore, FIG. 27 through FIG. 31 show an innermost cylinder body 10.

The clutch device C according to the embodiment is interposed between a gear Ra, or the like, of a transmission-receiving member R and a gear M, or the like, of a drive motor in order to transmit drive power only when necessary to the transmission-receiving member R such as a paper feed roller, or the like, which is used in a photocopier, facsimile, printer, or the like, so that the transmission-receiving member R is driven upon receiving transmission of the drive power of the drive motor.

Typically, in a case of a paper feed roller, since such a paper feed roller is provided on a paper supply tray of a photocopier, or the like, and on a transport path of copy paper, or the like, fed from a paper supply tray, such a clutch device C also is provided in various places of a photocopier, or the like, in correspondence with the paper feed rollers thus established.

Also, such a clutch device C operates so as to transmit the rotational force of the gear M on the side of the drive motor, which is always driven to rotate, to the gear Ra on the side of the transmission-receiving member R, only when the transmission of drive power to the transmission-receiving member R becomes necessary. (Below, the state in which rotational force is transmitted in the clutch device C is called the IN state, and the state when the rotational force is not transmitted is called the OFF state.)

Such a clutch device C comprises:

(1) a main shaft 1,
(2) an input side rotating body 2,
(3) an output side rotating body 3,
(4) an inner sleeve body 4,
(5) an outer sleeve body 5,
(6) an outermost cylinder body 6,
(7) a braking means 7,
(8) a first coil spring 8, and
(9) a second coil spring 9, and it is constituted by assembling these components.

The input side rotating body 2 has a gear part 20 (input end part) which engages a gear M on the side of the drive motor. Also, the input side rotating body 2 is made so as to be rotated around the main shaft 1.

The output side rotating body 3 has a gear part 30 (output end part) which engages a gear Ra on the side of the transmission-receiving member R such as a paper feed roller. Also, the output side rotating body 3 is made so as to be rotated around the main shaft 1.

The inner sleeve body 4 is disposed between the gear part 20 of the input side rotating body 2 and the gear part 30 of the output side rotating body 3. Also, the inner sleeve body 4 is caused to engage the output side rotating body 3 in a state being capable of movement only in the axial direction of the main shaft 1. That is, the inner sleeve body 4 is assembled to the output side rotating body 3 capable of rotating around the main shaft 1 with the main shaft 1 positioned therein.

The outer sleeve body 5 is disposed between the gear part 20 of the input side rotating body 2 and the gear part 30 of the output side rotating body 3 in a state holding the inner sleeve body 4 therein. That is, the inner sleeve body 4 is moved inside the outer sleeve body.5.

The first coil spring 8 is disposed between the inner sleeve body 4 and the outer sleeve body 5 so as to be wound on the inner sleeve body 4. Also, the first coil spring 8 is provided so as normally to urge the inner sleeve body 4 against the side of the gear part 20 of the input side rotating body 2, and also one end 80 of the spring is fastened to the inner sleeve body 4, and the other end 81 of the spring is fixed to the outer sleeve body 5. That is, the first coil spring 8 is disposed between the inner sleeve body 4 and the outer sleeve body 5 so as to be wound on the outside of the inner sleeve body 4.

Also, on each of the inner sleeve body 4 and the input side rotating body 2, there is provided main connection parts 21 and 40 engaging by the force and disengages by movement of the inner sleeve body 4 toward the direction opposing the force.

Also, on each of the inner sleeve body 4 and the outer sleeve body 5, there is provided sub connection parts 41 and 50 that rotate the outer sleeve body 5 in accompaniment by rotation of the inner sleeve body 4 accompanying rotation of the input side rotating body 2 in a state in which the main connection part 40 of the inner sleeve body 4 is caused to engage the main connection part 21 of the input side rotating body 2.

Also, the sub connection part 41 of the inner sleeve body 4 and the sub connection part 50 of the outer sleeve body 5 have cam surfaces 41*b* and 50*b*. By stopping the accompanying rotation of the outer sleeve body 5 by application of the braking force of the braking means 7 on the outermost cylinder body 6, the inner sleeve body 4 moves in the direction opposing the force while causing the first coil spring 8 to contract and compress or stretch the first coil spring 8 in the axial direction.

Also, a catching surface 41*c* formed on the sub connection part 41 of the inner sleeve body 4 and oriented toward the input end part of the input side rotating body 2 is made so as to be positioned at substantially the same level as a catching surface 50*c* formed on the sub connection part 50 of the outer sleeve body 5 and oriented toward the output end part of the output side rotating body 3 at a position where the inner sleeve body 4 is completely moved in opposition to the force.

Also, the outermost cylinder body 6 is assembled on the outside of the outer sleeve body 5 so as to hold at least a part of the outer sleeve body 5 inside in a state allowing rotation of the outer sleeve body 5 within a fixed range relative to the outer sleeve body 5. Also, on the outer surface part of the outermost cylinder body 6, it has a part 60 which is subject to the action of braking force of the braking means 7, and it is constituted so as to stop the accompanying rotation of the outer sleeve body 5 by the action of the braking force on this part 60.

Also, the second coil spring 9 is disposed such that one end 90 of the spring is fastened to the outer sleeve body 5, and the other end 91 of the spring is fastened to the outermost cylinder body 6. That is, the second coil spring 9 is disposed between the inner sleeve body 5 and the outermost cylinder body 6 so as to be wound on the outside of this outer sleeve body 5. Also, the second coil spring 9 is made so as to accumulate force causing the outer sleeve body 5 to rotate in reverse of the direction of forward rotation SF of the inner sleeve body by force-accumulating action of the outer sleeve body 5 in which the accompanying rotation is stopped after rotating in the same direction as the direction of forward rotation SF of the inner sleeve body 4 within the fixed range when braking force was applied to the outermost cylinder body 6.

As a result, according to the clutch device:

(1) In the state in which the accompanying rotation of the outer sleeve body 5 is not stopped by the outermost cylinder body 6 by applying braking force to the outermost cylinder body 6 by the braking means 7, the clutch device becomes in the IN state (state in which drive power is transmitted).

That is, because the main connection part 40 of the inner sleeve body 4 engages the main connection part 21 of the input side rotating body 2 by the force of the first coil spring 8, and because the inner sleeve body 4 engages the output side rotating body 3 in a state being capable of movement only in the axial direction of the main shaft 1, the rotational force of the input side rotating body 2 is transmitted to the output side rotating body 3 by the inner sleeve body 4, and the output side rotating body 3 is rotated. (Below, rotation in this direction is called forward rotation SF.) Also in the IN state, by the contact between the sub connection part 50 of the inner sleeve body 5 and the sub connection part 41 of the outer sleeve body 4, the outer sleeve body 5 also is rotated in accompaniment around the main shaft 1 in the same direction as the inner sleeve body 4 and the output side rotating body 3. (That is, all of these are rotated forward SF.) Furthermore, because the outermost cylinder body 6 is assembled on the outside of the outer sleeve body 5 so as to hold at least a part of the outer sleeve body 5 inside in a state allowing rotation of the outer sleeve body 5 within a fixed range relative to the outer sleeve body 5, the outermost cylinder body 6 also is rotated forward SF.

(2) Next, when the forward rotation SF of the outermost cylinder body 6 is stopped by the braking means 7, the accompanying rotation of the outer sleeve body 5 also is stopped, and the clutch device becomes the OFF state (state in which drive power is not transmitted).

That is, when the rotation of the outer sleeve body 5 which is rotated in accompaniment in the IN state is stopped by the braking means 7 via the outermost cylinder body 6, the inner sleeve body 4 rotated up to then is moved backward, while rotating forward SF in the direction opposing the forcing, that is, in the direction of disengaging between the main connection part 40 of the inner sleeve body 4 and the main connection part 21 of the input side rotating body 2, by the cam surface 41*b* or 50*b* provided on both or either one of the sub connection part 41 of the inner sleeve body 4 and the sub connection part 50 of the outer sleeve body 5. When it is disengaged in this manner, the rotational force of the input side rotating body 2 is no longer transmitted to the output side rotating body 3.

The catching surface 41*c* of the sub connection part 41 of the inner sleeve body 4 completely pushed in toward the direction of disengaging in this manner is positioned at substantially the same level as the catching surface 50*c* of the sub connection part 50 of the outer sleeve body 5. (Below, this state is called intermediate state.)

On the other hand, although the accompanying rotation of the outer sleeve body 5 is stopped after being rotated in the same direction as the direction of forward rotation SF of the inner sleeve body 4 within the fixed range when braking force is applied to the outermost cylinder body 6, because force causing the outer sleeve body 5 to rotate in reverse of the forward direction SF of the inner sleeve body 4 (that is, reverse rotation SR) is accumulated in the second coil spring 9 by this action, the outer sleeve body 5 is rotated in reverse SR by the elastic return force of the second coil spring 9, whereby the catching surface 41*c* of the sub connection part 41 of the inner sleeve body 4 and the catching surface 50*c* of the sub connection part 50 of the outer sleeve body 5 contact each other. Even if the rotational force in the direction of forward rotation SF acting on the inner sleeve body 4, that is, the rotational force acting on the input side rotating body 2, is not large, by the action of the second coil spring 9, the state of contact between the catching surface 41*c* of the sub connection part 41 of the inner sleeve body 4 and the catching surface 50*c* of the sub connection part 50 of the outer sleeve body 5 is produced assuredly. Because the inner sleeve body 4 is subject to the force by the first coil spring 8, unless the state in which the accompanying rotation of the outer sleeve body 5 is stopped is broken, the inner sleeve body 4 does not return to the position where the main connection part 40 engages the main connection part 21 of the input side rotating body 2, and in this OFF state, the input side rotating body 2 rotates idly without load around the main shaft 1.

In this OFF state, although the first coil spring 8 attempts to return to the ON state by causing the inner sleeve body 4 to rotate in reverse SR and causing the outer sleeve body 5 to rotate forward SF, because the outermost cylinder body 6 is stopped, the outer sleeve body 5 is not rotated forward SF past the intermediate state and up to the ON state. Also, because force in the direction of causing the outer sleeve body 5 to rotate in reverse SR again is accumulated in the second coil spring 9 when the outer sleeve body 5 is rotated forward SF within the fixed range, the OFF state is maintained as long as the outermost cylinder body 6 is stopped.

(3) Also, when the stoppage of the accompanying rotation of the outer sleeve body 5 by the braking means is released from the OFF state, the clutch device again becomes the IN state.

That is, when the action of the braking force on the outermost cylinder body 6 by the braking means 7 is released from the OFF state and the stoppage of the accompanying rotation of the outer sleeve body 5 is released, the outer sleeve body 5 rotates slightly in the direction of forward rotation SF by the elastic return force of the first coil spring 8 contracted in the OFF state, and the inner sleeve body 4 rotates slightly in the direction of reverse rotation SR, whereby it returns to the intermediate state. When the return to the intermediate state is accomplished, next, the inner sleeve body 4 is moved in the direction of being pushed against the input end part of the input side rotating body 2 by the elastic return force working in the axial direction of the first coil spring 8, and the main connection part 40 of the inner sleeve body 4 and the main connection part 21 of the input side rotating body 2 engage again. By this, the output side rotating body 3 is rotated again by the rotational driving of the input side rotating body 2 by the inner sleeve body 4.

That is, according to the clutch device C, in the case when it is not necessary to transmit drive power to the transmission-receiving member R, the input side rotating body 2 can be rotated without load, and in the OFF state, the clutch device C does not apply a load to the drive motor driving the input side rotating body 2. Also, in the OFF state, it can be made such that transmission of power to the output side rotating body 3 does not occur at all.

Also, in the event of transmitting drive power to the transmission-receiving member R, by causing the main connection part 40 of the inner sleeve body 4 and the main connection part 21 of the input side rotating body 2 to engage, the rotational force can be transmitted to the output side rotating body 3 without power loss.

Also, in this embodiment, the maximum value of the force accumulated in the first coil spring 8 is made greater than the maximum value of the force accumulated in said second coil spring 9.

Accordingly, in this embodiment, the return from the intermediate state to the IN state can be accomplished smoothly. That is, when moving from the OFF state to the intermediate state is performed, force in the direction of causing the outer sleeve body 5 to rotate in reverse SR is accumulated again in the second coil spring 9. If the maximum value of the force accumulated in the first coil spring 8 is made greater than the maximum value of the force accumulated in the second coil spring 9, the outer sleeve body 5 can be caused to rotate appropriately in the direction of forward rotation SF by the elastic return force of this first coil spring 8, whereby it can be returned from the intermediate state to the IN state without obstruction.

Also, in this embodiment: the cam surface 41*b* of the sub connection part 41 of the inner sleeve body 4 is made as a surface oriented toward the direction of forward rotation SF of the inner sleeve body 4, and is an inclined surface inclined toward the side of the direction of reverse rotation SR of the inner sleeve body 4 as it approaches the catching surface 41*c* of this sub connection part 41.

Also, the cam surface. 50*b* of the sub connection part 50 of the outer sleeve body 5 is made as a surface oriented toward the direction of reverse rotation SR of the inner sleeve body 4, and is an inclined surface inclined toward the side of the direction of forward rotation SF of this inner sleeve body 4 as it approaches the catching surface 50*c* of this sub connection part 50.

By this, in this embodiment, moving from the ON state to the intermediate state can be accomplished more smoothly.

The braking means 7 may be of any constitution as long as it is constituted such that the accompanying rotation of the outer sleeve body 5 is stopped by the action of its braking force on the outermost cylinder body 6 in the case when it is not necessary to transmit drive power to the transmission-receiving member R, for example in the state in which it is not necessary to feed paper if the transmission-receiving member R is a paper feed roller.

Typically, as such braking means 7, a structure can be used in which a coupling arm, or the like, is caused to operate so as to couple with the part 60 subject to the action of the braking force on the outermost cylinder body 6, or clamp this part 60, such that the accompanying rotation of the outer sleeve body 5 is blocked by means of the outermost cylinder body 6, and also to break the coupling using an electromagnet excited based on signals input when paper feeding is performed in a photocopier, or the like.

In the illustrated example, the main shaft 1, input side rotating body 2, output side rotating body 3, inner sleeve body 4, outer sleeve body 5, outermost cylinder body 6, first coil spring 8, and second coil spring 9 respectively have the concrete constitutions below.

(Main Shaft 1)

In the illustrated example, the main shaft 1 is formed in a round rod-shaped body of which one end is fixed to a frame F fixed to the side of the main body of a photocopier, or the like.

In the illustrated example, it is made such that from the side of the other end of the main shaft 1, starting with the side of the output side rotating body 3, the clutch main body Ca, which is made by assembling the output side rotating body 3, inner sleeve body 4, outer sleeve body 5, outermost cylinder body 6, input side rotating body 2, first coil spring 8, and second coil spring 9, is installed on the main shaft 1 in a state in which the main shaft 1 is inserted through their insides.

In the illustrated example, the main shaft 1 is inserted through the inside of an innermost cylinder body 10, which is open at both ends of the cylinder and has a flange 100 on one end side of the cylinder and a gear part 101 between the flange 100 and the one end of the cylinder. The various parts are equipped on the outside of the innermost cylinder body 10. That is, in the illustrated example, the clutch main body Ca is constituted in a manner such that between the flange 100 of the innermost cylinder body 10 and the other end of the cylinder, in the order starting with the output side rotating body 3, and next the inner sleeve body 4, and finally the input side rotating body 2, the innermost cylinder body 10 is passed through these. Furthermore, the outer sleeve body 5 is disposed on the outside of the inner sleeve body 4, and furthermore, the outermost cylinder body 6 is disposed on the outside of the outer sleeve body 5. That is, the clutch main body Ca is made so as to be assembled on the main shaft 1 so as to be rotated as a whole around the main shaft 1. On the other end of the cylinder of the innermost cylinder body 10, on a coupling part 23 formed inside a cylindrical part 22 constituting the input side rotating body 2, there is formed a coupling claw 102 which is coupled pursuant to insertion of the other end of the cylinder of the innermost cylinder body 10 on the cylindrical part 22. In addition, there is formed a tongue 103 which enters into a groove 24 following the axial direction of the main shaft 1 formed on the inside of the cylindrical part 22. In the illustrated example, it is made such that the input side rotating body 2 and the innermost cylinder body 10 are rotated as one body around the main shaft 1 in both the ON state and OFF state.

In the illustrated example, a gear M on the side of the drive motor is disposed above the main shaft 1, and it is made such that the gear M engages the gear part 20 of the input side rotating body 2, and the input side rotating body 2 and the innermost cylinder body 10 are rotated even in the OFF state.

In the IN state, the output side rotating body 3 is rotated by means of the inner sleeve body 4 which has the main connection part 40 engaging the input side rotating body 2 which is rotated and engages the gear M on the side of the drive motor. The drive power is transmitted to the transmission-receiving member R through the gear Ra on the side of the transmission-receiving member R engaging the gear part 30 of the output side rotating body 3.

(Input Side Rotating Body 2)

The input side rotating body 2 comprises: a cylindrical part 22 which is open at both ends of the cylinder; and a gear part 20 which forms a flange shape around one end of the cylinder of this cylindrical part 22, and has tooth parts on the projecting end. The tooth parts of the gear part 20 are partitioned from adjacent tooth parts by grooves in the direction following the cylinder axis of the cylindrical part 22.

The cylindrical part 22 is constituted so as to have an inner diameter capable of inserting the innermost cylinder body 10 from the side of the other cylinder end of the cylindrical part 22. Also, it is made such that the input side rotating body 2 is rotated around the main shaft 1 by means of the innermost cylinder body 10 which is inserted into the cylindrical part 22 in this manner and assembled in this cylindrical part 22.

Also, the cylindrical part 22 is constituted so as to have an outer diameter capable of being inserted inside the inner sleeve body 4.

Also, the main connection part 21 of the input side rotating body 2 is formed on the other end of the cylinder opposite to the side where the gear part 20 on the cylindrical part 22 is formed.

In the illustrated example, the main connection part 21 of the input side rotating body 2 is constituted by providing plural projections 21*a*, 21*a*, . . . in the direction around the cylinder axis of the cylindrical part 22 at substantially equal intervals between adjacent projections 21*a*.

(Output Side Rotating Body 3)

The output side rotating body 3 comprises: a cylindrical part 31 which is open at both ends of the cylinder; and a gear part 30 which forms a flange shape around one end of the cylinder of the cylindrical part 31, and has tooth parts on the projecting end. The tooth parts of the gear part 30 are partitioned from adjacent tooth parts by grooves in the direction following the cylinder axis of the cylindrical part.

On the other end of the cylinder of such cylindrical part 30, there are formed three cutout parts 32 which are opened outward on the other end of the cylinder and extend toward the side of the one end of the cylinder. Between the adjacent cutout parts 32 and 32, substantially equal intervals are formed in the direction going around the cylinder axis of the cylindrical part 30.

Also, the cylindrical part 30 of the output side rotating body 3 is constituted so as to have an inner diameter capable of accepting the innermost cylindrical body 10. In the illustrated example, it is made such that the output side rotating body 3 is assembled on the innermost cylindrical body 10 by inserting the innermost, cylinder body 10 through the cylindrical part 31 of the output side rotating body 3 from the one end of the cylinder of the cylindrical part 31, to be capable of rotating around the innermost cylinder body 10 inserted through in this manner.

Also, the cylindrical part 31 of the output side rotating body 3 is constituted so as to have an outer diameter capable of being inserted inside the inner sleeve body 4 to be described later. In addition to that, on the inner surface part of the inner sleeve body 4, there are formed rib-shaped parts 42 which enter into the cutout parts 32 in a state in which the cylindrical part 31 of the output side rotating body 3 is inserted through the inside of the inner sleeve body 4. By inserting the rib-shaped parts 42 into the cutout parts 32, the inner sleeve body 4 is assembled on the output side rotating body 3 in a state capable of movement only in the cylinder axial direction of the cylindrical part 31 of the output side rotating body 3, that is, the axial direction of the main shaft 1. (FIG. 2)

(Inner Sleeve Body 4)

The inner sleeve body 4 is constituted so as to have a cylindrical shape which is open at both ends.

On the inner surface part of the inner sleeve body 4, there are formed the rib-shaped parts 42. The rib-shaped parts 42 are provided in three groups, two per group, and it is made such that each group is inserted from the input end side of the input side rotating body into the corresponding cutout part 32 formed on the cylindrical part of the output side rotating body 3. A pitch of a pair of the rib-shaped parts 42 and 42 is substantially equal to the width dimension of the cutout part 32. The inner sleeve body 4 which is assembled on the output side rotating body 3 by inserting the rib-shaped parts 42 into the cutout parts 32 causes the output side rotating body 3 to rotate simultaneously in the case when the inner sleeve body 4 is rotated. In addition, in this assembled state, it becomes capable of movement in the axial direction of the main shaft 1.

Also, the main connection part 40 and the sub connection part 41 are formed on the side of one sleeve end of the inner sleeve body 4.

In the illustrated example, the main connection part 40 of the inner sleeve body 4 is constituted by plural projections 40*a*, 40*a*, . . . provided inside one sleeve end of the inner sleeve body 4. The respective projections 40*a*, 40*a*, . . . are provided in the direction around the cylinder axis of the inner sleeve body at substantially equal intervals between the adjacent projections 40*a* and 40*a*. Also, in the illustrated example, in the IN state, by the force acting on the inner sleeve body 4 by the first coil spring 8, the projections 40*a* respectively enter into recesses formed between the plural projections 21*a*, 21*a*, . . . constituting the main connection part 21 of the input side rotating body 2, whereby the inner sleeve body 4 and the input side rotating body 2 are connected. Because the inner sleeve body 4 is assembled on the output side rotating body 3 in a state being capable of movement only in the axial direction of the main shaft 1 by inserting the rib-shaped parts 42 into the cutout parts 32 of the output side rotating body 3, in the IN state, it becomes that the output side rotating body 3 is rotated accompanying the rotation of the input side rotating body 2 by means of the inner sleeve body 4.

Also, in the illustrated example, the sub connection part 41 of the inner sleeve body 4 is formed on a surface part oriented toward one sleeve end side of the inner sleeve body 4 in a collar-shaped part 43 formed on the one sleeve end side, having a slight interval between it and the one end side of the inner sleeve body 4.

The sub connection part 41 is constituted by plural protruding parts 41*a*, 41*a*, . . . which stick out toward the one sleeve end side of the inner sleeve body 4 from the surface part of the collar-shaped part 43.

All of the protruding parts 41*a*, 41*a*, . . . are provided so as to be at substantially equal intervals between the adjacent protruding parts 41*a* and 41*a*.

Also, on each protruding part 41*a*, 41*a*, . . . , the side surface oriented toward the direction of forward rotation SF of the inner sleeve body 4 is taken as a cam surface 41*b* which is inclined so as to gradually retreat toward the side of the direction of reverse rotation SR as it goes toward the top part of the protruding part 41*a*.

Also, on each protruding part 41*a*, 41*a*, . . . , its top part is formed by a surface in a direction substantially orthogonal to the axis of the main shaft 1, and it is made such that the surface of the top part functions as a catching surface 41*c* for maintaining the OFF state.

Concretely, in the illustrated example, it is made such that the top part, that is, the catching surface 41*c*, of each protruding part 41*a*, 41*a*, . . . is positioned further downward from the end surface of the one sleeve end of the inner sleeve body 4.

(Outer Sleeve Body 5)

The outer sleeve body 5 is constituted so as to form a cylindrical shape which is open at both ends of the cylinder.

The outer sleeve body 5 is constituted so as to have an inner diameter to contain the inner sleeve body 4 disposed inside from one sleeve end side so as to have the first coil spring 8 wound on the outside, in a state allowing movement of the side of the inner sleeve body 4 in the rotational direction inside the outer sleeve body 5, and the contraction of the first coil spring 8 as well as the compression of the first coil spring 8.

Also, the sub connection part 50 is formed almost in the center in the cylinder axial direction of the outer sleeve body 5. In the illustrated example, the sub connection part 50 of the outer sleeve body 5 is formed on a step surface part 51 formed on the inner surface part of the outer sleeve body 5 and oriented toward one sleeve end side of the outer sleeve body.

Concretely, in the illustrated example, the sub connection part 50 of the outer sleeve body 5 is constituted by forming plural recessed parts 50*a*, 50*a*, . . . which sink in toward the input end side of the input side rotating body on the step surface part 51.

All of the recessed parts 50*a*, 50*a*, . . . are provided at substantially equal intervals between adjacent recessed parts 50*a* and 50*a*.

Also, on each recessed part 50*a*, 50*a*, . . . , the inner surface of the recessed part oriented toward the direction of reverse rotation SR of the inner sleeve 4 is taken as a cam surface 50*b* which is inclined so as to gradually approach toward the side of the direction of forward rotation SF of the inner sleeve body as it goes toward the entrance of the recessed part 50*a*.

Also, the step surface part 51 between each recessed part 50*a*, 50*a*, . . . becomes the surface in the direction orthogonal to the axis of the main shaft 1, and it is made such that the surface between the adjacent recessed parts 50*a* and 50*a* functions as the catching surface 50*c* for maintaining the OFF state.

Also, it is made such that the inner sleeve body 4 held inside the outer sleeve body 5 is assembled in the outer sleeve body 5 in a state in which in the IN state, the protruding parts 41*a* formed on the collar-shaped part 43 are inserted into the corresponding recessed parts 50*a* formed on the step surface part 51 of the outer sleeve body 5 from the gear part 30 of the output side rotating body 3 by the force of the first coil spring 8.

Concretely, it is made such that in the IN state, the protruding parts 41*a* completely enter into the recessed parts 50*a* in a state in which the cam surfaces 41*b* of the protruding parts 41*a* constituting the sub connection part 41 of the inner sleeve body 4 and the cam surfaces 50*b* of the recessed parts 50*a* constituting the sub connection part 50 of the outer sleeve body 5 are placed in contact with each other. (FIG. 2)

Also, on the other sleeve end part of such outer sleeve body 5, recessed places 52 are formed respectively on two sides in its diameter direction. Also, it is made such that the outermost cylinder body 6 to be described later is disposed on the outside of the outer sleeve body 5 in a state in which protruding places 61 formed on one cylinder end of the outermost cylinder body 6 and protrude inside the outermost cylinder body 6 are inserted into the recessed places 52. The length of the recessed places 52 in the direction going around the cylinder axis of the outer sleeve body 5 is longer than the length of the protruding places 61, whereby it is made such that the outer sleeve body 5 can rotate within a fixed range, being the difference of measurements of the recessed places 52 and the protruding places 61, even when the outermost cylinder body 6 is braked by the braking means 7.

(Outermost Cylinder Body 6)

The outermost cylinder body 6 is constituted so as to form a cylindrical shape which is open at both ends of the cylinder. The outermost cylinder body 6 is constituted so as to have an inner diameter to contain the outer sleeve body 5 disposed inside from the other end side of the cylinder so as to have the second coil spring 9 wound on the outside, in a state allowing movement of the side of this outer sleeve body 5 in the rotational direction inside the outermost cylinder body 6, and the contraction of the second coil spring 9.

Also, on the one end of the cylinder of the outermost cylinder body 6, protruding places 61 which are formed so as to enter into the recessed places 52 of the outer sleeve body 5 and protrude inside the outermost cylinder body 6 are formed respectively in positions on two sides in the diameter direction of the outermost cylinder body 6.

Also, on the outer surface part of the outermost cylinder body 6, there are formed plural ribs 60*a*, 60*a*, . . . for coupling extending in the direction following the axis of the main shaft. In the illustrated example, the respective ribs 60*a*, 60*a*, . . . for coupling are provided at equal intervals between the adjacent ribs 60*a* for coupling in the rotational direction of the main shaft 1. Also, it is made such that a coupling claw part 70 constituting the braking means 7 couples with one of the ribs 60*a* for coupling in the OFF state whereby the rotation of the outermost cylinder body 6 is blocked.

In the IN state, the inner sleeve body 4 normally is forced in the direction of being pushed against the side of the gear part 20 of the input side rotating body 2 by the force of the first coil spring 8, and its main connection part 40 is connected to the main connection part 21 of the input side rotating body 2. Therefore, in the IN state, the inner sleeve body 4 also is rotated forward SF accompanying the forward rotation SF of the input side rotating body 2. Furthermore, the output side rotating body 3, which is assembled on the inner sleeve body 4 in a state enabling movement of the inner sleeve body 4 only in the axial direction of the main shaft 1, also is rotated forward SF. Also, in the IN state, because the outer sleeve body 5 and the inner sleeve body 4 are assembled by inserting the protruding parts 41*a* in the recessed parts 50*a*, in the IN state, the outer sleeve body 5 also is rotated forward SF. Furthermore, in the outermost cylinder body 6, because the protruding places 61 are inserted inside the recessed places 52 of the outer sleeve body, the outermost cylinder body 6 also is rotated forward SF by the forward rotation SF of the outer sleeve body. That is, in the IN state, the clutch main body Ca is rotated as a whole around the main shaft 1 (FIG. 2).

When the forward rotation SF of the outermost cylinder body 6 is blocked by the braking means 7 from the IN state, after the outer sleeve body 5 is rotated slightly forward SF within a fixed range within the range of the recessed places 52, the accompanying rotation toward the direction of the forward rotation SF is stopped. By the forward rotation within a fixed range of the outer sleeve body 5, force causing the outer sleeve body 5 to rotate in the direction of reverse rotation SR within the range of the recessed places 52 is accumulated in the second coil spring 9. When the accompanying rotation of the outer sleeve body 5 is stopped, the cam surfaces 41*b* constituting the sub connection part 41 of the inner sleeve body 4 are pushed firmly to the cam surfaces 50*b* of the recessed places 50*a* constituting the sub connection part 50 of the outer sleeve body 5 which is stopped, the inner sleeve body 4 is moved toward the side of the output side rotating body 3 in opposition to the force of the first coil spring 8 while compressing the first coil spring 8 by the inclination of the cam surfaces 41*b* and 50*b* which are pushed together in this manner, and also contracting the first coil spring 8 by the amount of rotation following the inclination of the cam surfaces 41*b* and 50*b*. When the inner sleeve body 4 is moved in this manner, the respective projections 40*a*, 40*a*, . . . constituting the main connection part 40 of the inner sleeve body 4 escape from the respective projections 21*a*, 21*a*, . . . constituting the main connection part 21 of the input side rotating body 2, and the connection between the two is broken. Also, the inner sleeve body 4 causes the protruding parts 41*a* to escape from the recessed part 50*a*, and the catching surfaces 41*c* of the sub connection part 41 of the inner sleeve body 4 come to be positioned at substantially the same level as the catching surfaces 50*c* of the sub connection part 50 of the outer sleeve body 5 (FIG. 3 to FIG. 4). In this state, because the outer sleeve body 5 becomes capable of rotating in the direction of reverse rotation SR, the outer sleeve body 5 is rotated in reverse within the range of the recessed places 52 by the force of the second coil spring 9, and the catching surfaces 41*c* of the sub connection part 41 of the inner sleeve body 4 come to be pushed against the catching surfaces 50*c* of the sub connection part 50 of the outer sleeve body 5 from the side of the gear part 30 of the output side rotating body 3. By this, the OFF state is maintained. (FIG. 5)

When the rotation-blocking state of the outermost cylinder body 6 by the braking means 7 is released from the OFF state, that is, when the coupling between the coupling claw part 70 constituting the braking means 7 and the ribs 60*a* for receiving coupling of the outermost cylinder body 6 is released, the outer sleeve body 5 is rotated slightly in the direction of forward rotation SF by the elastic return force of the first coil spring 8 contracted, and the inner sleeve body 4 is rotated slightly in the direction of reverse rotation SR. At this time, because force in the direction of causing the outer sleeve body 5 to rotate in reverse. SR again is accumulated in the second coil spring 9, and because the force in the reverse direction of the first coil spring 8 is made greater than the force in the direction of the second coil spring 9, the rotation of the outer sleeve body 5 toward the direction of forward rotation SF at this time is not obstructed. When the outer sleeve body 5 and the inner sleeve body 4 are rotated in this manner, the protruding parts 41 again come to be inserted into the recessed parts 50*a*. The inner sleeve body 4 is moved to the side of the gear part 20 of the input side rotating body 2 up to the position where the protruding parts 41*b* are completely inserted in the recessed parts 50*b* by the elastic return force of the first coil spring 8 which is also compressed in the OFF state. The main connection parts 21 and 40 of the two are caused to be engaged again. By this, the return to the IN state is accomplished.

(First Coil Spring 8)

In the illustrated example, a compression coil spring is used as the first coil spring 8. Also, the first coil spring 8 is disposed between the inner sleeve body 4 and the outer sleeve body 5 so as to be wound on the inner sleeve body 4 in a state allowing contraction in the manner. That is, it is made such that the inner sleeve body 4 is inserted inside the wound part of the first coil spring 8, and the inner sleeve body 4 inserted inside the wound part of the first coil spring 8 is inserted inside the outer sleeve body 5.

In the illustrated example, incorporation of the first coil spring 8 is accomplished by inserting one end 80 of the spring of the coil spring 8 from the gear part 30 of the output side rotating body 3 into a small hole 43*a* formed in the collar-shaped part 43 of the inner sleeve body 4, and fastening the one end 80 of the spring to the inner sleeve body 4, and also inserting the other end 81 of the spring of the first coil spring 8 from the side of the gear part 30 of the output side rotating body 3 into a notch 53 opened outwardly in the sleeve end of the outer sleeve body 5 on the side of the gear part 30 of the output side rotating body 3, and fastening the other end 81 of the spring in a suspended manner to the outer sleeve body 5. Also, it is made such that the first coil spring 8 is compressed by causing the other end 81 of the spring to be pushed against the gear part 30 of the output side rotating body 3, whereby the inner sleeve body 4 is normally forced in the direction of pushing against the input end part of the input side rotating body 2.

The first coil spring 8 is constituted so as to be contracted by rotation due to the cam surfaces 41*b* and 50*b* of the inner sleeve body 4 from the state in which the accompanying rotation of the outer sleeve body 5 is blocked by the braking means 7.

(Second Coil Spring 9)

In the illustrated example, the second coil spring 9 is disposed between the outermost cylinder body 6 and the outer sleeve body 5 so as to be wound on the outer sleeve body 5. That is, it is made such that the outer sleeve body 5 is inserted inside the wound part of the second coil spring 9, and the outer sleeve body 5 inserted in the wound part of the second coil spring 9 in this manner is inserted inside the outermost cylinder body 6.

In the illustrated example, incorporation of the second coil spring 9 is accomplished by inserting one end 90 of the spring of this second coil spring 9 from the side of the gear part 20 of the input side rotating body 2 into a small hole 55 formed in an outer surface part of the outer sleeve body 5 and formed in a step surface 54 oriented toward the side of the sleeve end where the recessed place 52 of the outer sleeve body 5 is formed, and fastening the one end 90 of the spring to the outer sleeve body 5, and also inserting the other end 91 of the spring of the second coil spring 9 from the side of the gear part 30 of the output side rotating body 3 into a small hole 62 formed on the side of the cylinder end where the protruding place 61 of the outermost cylinder body 6 is formed, and fastening the other end 91 of the spring to the outermost cylinder body 6.

The disclosure of Japanese Patent Application No. 2004-053408, filed on Feb. 27, 2004, is incorporated in the application.

While the invention has been explained with reference to the specific embodiments of the invention, the explanation is illustrative and the invention is limited only by the appended claims.

What is claimed is:

1. A clutch device for transmitting drive power to a transmission-receiving member, comprising:

a main shaft;

an input side rotating body rotating around the main shaft and having an input end part;

an output side rotating body rotating around the main shaft for transmitting the drive power to the transmission-receiving member, said output side rotating body having an output end part;

an inner sleeve body disposed between the input end part of the input side rotating body and the output end part of the output side rotating body, said inner sleeve body being assembled with the output side rotating body such that the inner sleeve body moves only in an axial direction of the main shaft;

an outer sleeve body disposed between the input end part of the input side rotating body and the output end part of the output side rotating body such that the outer sleeve body retains the inner sleeve body therein;

a braking device disposed adjacent to the outer sleeve body for braking the outer sleeve body;

a first coil spring having one end fixed to the inner sleeve body for urging the inner sleeve body with a first urging force toward the input end part of the input side rotating body, and the other end fixed to the outer sleeve body;

a main connection for connecting the input side rotating body and the inner sleeve body, said main connection engaging with the first urging force of the first coil spring and disengaging when the inner sleeve body moves against the first urging force;

a sub connection for connecting the inner sleeve body and the outer sleeve body so that the outer sleeve body rotates when the inner sleeve body rotates in a forward direction through an engagement of the main connection;

a cam formed at the sub connection so that at least a part of the sub connection moves the inner sleeve body against the first urging force so as to compress or stretch the first coil spring in an axial direction thereof so that the first coil spring accumulates an urging force to rotate the inner sleeve body in a direction opposite to the forward direction when the braking device stops the outer sleeve body;

a catching portion having a first catching surface formed on a part of the sub connection and facing the input end part of the input side rotating body, and a second catching surface formed on the other part of the sub connection and facing the output end part, said second catching surface being situated at a level same as that of the first catching surface when the inner sleeve body is completely moved against the first urging force;

an outermost cylinder body disposed outside the outer sleeve body for retaining therein at least a part of the outer sleeve body so that the outer sleeve body rotates within a predetermined range, said outermost cylinder body having a part on an outer surface thereof for receiving an action of the braking device so that the outer sleeve body is stopped when the braking device acts on the part; and a second coil spring having one end fixed to the outer sleeve body and the other end fixed to the outermost cylinder body, said second coil spring accumulating a second urging force to rotate the outer sleeve body in the direction opposite to the forward direction when the braking device acts on the part to stop the outer sleeve body after rotating in the forward direction within the predetermined range.

2. A clutch device according to claim 1, wherein said main connection includes a first main connection part formed on the input side rotating body, and a second main connection part formed on the inner sleeve body, and said sub connection includes a first sub connection part formed on the inner sleeve body, and a second sub connection part formed on the outer sleeve body.

3. A clutch device according to claim 2, wherein said cam includes a first cam surface formed on the first sub connection part, and a second cam surface formed on the second sub connection part for abutting against the first cam surface.

4. A clutch device according to claim 3, wherein said first coil spring accumulates the first urging force having a maximum value greater than that of the second urging force accumulated in the second coil spring.

5. A clutch device according to claim 4, wherein said first cam surface faces the forward direction and is inclined relative to the direction opposite to the forward direction toward the first catching surface, and said second cam surface faces the direction opposite to the forward direction rotation and is inclined relative to the forward direction toward the second catching surface.

* * * * *